US009254975B2

(12) United States Patent
Tamura et al.

(10) Patent No.: US 9,254,975 B2
(45) Date of Patent: Feb. 9, 2016

(54) RECORDING APPARATUS AND MEDIUM FEEDING DEVICE

(71) Applicant: SEIKO EPSON CORPORATION, Tokyo (JP)

(72) Inventors: Tetsuya Tamura, Matsumoto (JP); Narihiro Oki, Matsumoto (JP); Tatsuya Shirane, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/220,603

(22) Filed: Mar. 20, 2014

(65) Prior Publication Data

US 2014/0291914 A1 Oct. 2, 2014

(30) Foreign Application Priority Data

Mar. 27, 2013 (JP) ..... 2013-067563

(51) Int. Cl.

| | |
|---|---|
| ***B65H 3/44*** | (2006.01) |
| ***B65H 7/04*** | (2006.01) |
| ***B65H 1/26*** | (2006.01) |
| ***B65H 3/06*** | (2006.01) |
| ***B65H 5/06*** | (2006.01) |

(Continued)

(52) U.S. Cl.

CPC ..... *B65H 7/04* (2013.01); *B65H 1/266* (2013.01); *B65H 3/0669* (2013.01); *B65H 3/0684* (2013.01); *B65H 3/44* (2013.01); *B65H 5/062* (2013.01); *B65H 5/38* (2013.01); *B65H 7/14* (2013.01); *B65H 2402/32* (2013.01); *B65H 2402/441* (2013.01); *B65H 2403/22* (2013.01); *B65H 2403/42* (2013.01); *B65H 2404/1531* (2013.01); *B65H 2404/513* (2013.01); *B65H 2405/324* (2013.01); *B65H 2405/332* (2013.01); *B65H 2511/152* (2013.01); *B65H 2511/212* (2013.01); *B65H 2511/414* (2013.01); *B65H 2511/51* (2013.01); *B65H 2515/60* (2013.01); *B65H 2557/10* (2013.01); *B65H 2557/30* (2013.01); *B65H 2601/26* (2013.01)

(58) Field of Classification Search

CPC ..... B65H 3/0669; B65H 3/0684; B65H 3/44; B65H 1/04; B65H 3/0661; B65H 2405/332; B65H 2407/21; B65H 1/266; B65H 2301/4454; B65H 2511/152; B65H 2511/515; B65H 2511/40; B65H 2511/41; B65H 2553/40; B65H 2553/41; B65H 2553/414; B65H 2511/51

USPC ..... 271/114, 117, 118, 9.01, 9.07, 9.08, 271/9.09, 9.11, 9.13, 265.01, 258.01

See application file for complete search history.

(56) References Cited

U.S. PATENT DOCUMENTS

| | | | | |
|---|---|---|---|---|
| 4,196,898 A * | 4/1980 | Misawa et al. | ..... | 271/9.08 |
| 5,737,682 A * | 4/1998 | Yamagishi | ..... | 399/402 |
| 6,547,234 B1 * | 4/2003 | Quesnel | ..... | 271/9.08 |

(Continued)

FOREIGN PATENT DOCUMENTS

| | | |
|---|---|---|
| JP | 2006-282311 | 10/2006 |
| JP | 2007-091445 | 4/2007 |

*Primary Examiner* — Thomas Morrison

(74) *Attorney, Agent, or Firm* — Workman Nydegger

(57) ABSTRACT

A printer includes a lower tray and an upper tray disposed above the lower tray. An optical sensor which detects the presence or absence of a sheet is disposed above the upper tray. The optical sensor is disposed in a roller support member which supports a feeding roller and serves as a swingable swing member. A distance between the optical sensor and the sheet is adjusted by swing of the roller support member according to the number of sheets.

6 Claims, 20 Drawing Sheets

(51) Int. Cl.
*B65H 5/38* (2006.01)
*B65H 7/14* (2006.01)

(56) References Cited

U.S. PATENT DOCUMENTS 6,599,041 B1 * 7/2003 Ahne et al. ..... 400/582
7,828,282 B2 * 11/2010 Zhang ..... 271/110
7,887,038 B2 * 2/2011 Shigeno et al. ..... 271/9.08
7,904,016 B2 * 3/2011 Kuwahara et al. ..... 399/367
8,181,953 B2 * 5/2012 Zhang ..... 271/9.07
8,439,351 B1 * 5/2013 Burke ..... 271/110
2006/0083129 A1 * 4/2006 Yun et al. ..... 369/47.1
2007/0075477 A1 4/2007 Shiohara
2010/0019441 A1 * 1/2010 Zhang ..... 271/110
2010/0021187 A1 * 1/2010 Zhang ..... 399/23

* cited by examiner

RECORDING APPARATUS AND MEDIUM FEEDING DEVICE

BACKGROUND

1. Technical Field

The present invention relates to a recording apparatus and a medium feeding device which include a medium accommodation unit for accommodating a medium and a medium detection unit that detects the presence or absence of the medium in the medium accommodation unit.

2. Related Art

In a recording apparatus represented by a facsimile machine and a printer, a sheet feeding tray (cassette) which is attachable to and detachable from an apparatus body has been widely used in the related art. In some cases, a sensor is disposed so as to detect the presence or absence of a sheet or to detect the presence or absence of the sheet feeding cassette itself. In addition, when separate sensors respectively detect the presence or absence of the sheet and mounting of the sheet feeding cassette, the cost is increased. In view of the increasing cost, a sheet feeding device disclosed in JP-A-2006-282311 has a configuration where one sensor detects the mounting of the sheet feeding cassette and the presence or absence of the sheet.

Incidentally, the number of sheets inside the sheet feeding tray varies each time. Accordingly, for example, in a configuration where an optical sensor is arranged at a position opposing the sheet feeding tray and the presence or absence of the sheet is detected by using a change in reflectivity, there is a possibility that detection accuracy may also vary due to a changing distance between the optical sensor and the sheet depending on the number of sheets.

For example, when the number of sheets is small, a reflection position (uppermost position of the sheet) of light emitted from the optical sensor is far from the optical sensor. Accordingly, there is a possibility that a light amount of reflection light received by a light receiving unit may be decreased and thus the detection accuracy may be degraded. In order to prevent such a problem, the light amount of the reflection light is determined based on a case where the number of sheets is small. In this case, there is a possibility that the light amount of the reflection light received by the light receiving unit may be increased when the number of sheets is large and the light receiving unit may be progressively degraded.

SUMMARY

An advantage of some aspects of the invention is to more properly detect the presence or absence of a sheet inside a sheet accommodation unit.

According to an aspect of the invention, there is provided a recording apparatus including: a recording unit that performs recording on a medium; a medium accommodation unit that accommodates the medium; a feeding member that is swingable and feeds the medium from the medium accommodation unit; and a medium detection unit that is disposed in the feeding member and detects the presence or absence of the medium inside the medium accommodation unit.

In this case, the medium detection unit that detects the presence or absence of the medium inside the medium accommodation unit is disposed in the swingable feeding member. Therefore, it is possible to adjust a position of the medium detection unit according to the number of media accommodated in the medium accommodation unit, and thus it is possible to properly detect the presence or absence of the medium.

In the recording apparatus, the feeding member may include a feeding roller which feeds the medium from the medium accommodation unit and may change a posture according to the number of media inside the medium accommodation unit.

In this case, a swing member includes (is provided with) the feeding roller which feeds the medium from the medium accommodation unit. Therefore, one feeding member can be used as both of the feeding roller and the medium detection unit, and thus it is possible to reduce the configuring cost.

In the recording apparatus, multiple medium accommodation units may be configured to include at least a lower medium accommodation unit and an upper medium accommodation unit positioned above the lower medium accommodation unit, and the upper medium accommodation unit is slidingly operable with respect to the lower medium accommodation unit. The medium detection unit may be configured to have an optical sensor that includes a light emitting unit and a light receiving unit which oppose the medium accommodated in the medium accommodation unit. An angle $\alpha 1$ formed between an optical axis of light emitted from the light emitting unit and the medium when the light emitting unit opposes the medium accommodated in the lower medium accommodation unit may be closer to a right angle than an angle $\alpha 2$ formed between the optical axis and the medium when the light emitting unit opposes the medium accommodated in the upper medium accommodation unit.

In this case, the medium detection unit is configured to have the optical sensor. Accordingly, as the optical axis thereof is closer to the right angle with respect to the medium (including the right angle), light receiving intensity in the light receiving unit becomes stronger. Therefore, it is possible to properly detect the presence or absence of the medium. In addition, as a distance between the medium detection unit and the medium is closer, the light receiving intensity in the light receiving unit becomes stronger. Therefore, it is possible to properly detect the presence or absence of the medium.

Incidentally, the angle formed between the swing member and the medium is further increased in a case where the feeding roller comes into contact with the medium accommodated in the lower medium accommodation unit, as compared to a case where the feeding roller comes into contact with the medium accommodated in the upper medium accommodation unit. Therefore, insofar as the medium detection unit is disposed in a place apart from a swing center of the swing member, the distance between the light emitting unit and the medium becomes longer in the case where the feeding roller comes into contact with the medium accommodated in the lower medium accommodation unit, as compared to the case where the feeding roller comes into contact with the medium accommodated in the upper medium accommodation unit.

That is, when the medium detection unit is arranged in the swing member, a detection distance becomes longer in a case where the medium detection unit opposes the lower medium accommodation unit, as compared to a case the medium detection unit opposes the upper medium accommodation unit. Accordingly, from a viewpoint of detecting the presence or absence of the medium, the lengthened detection distance is disadvantageous.

Therefore, the embodiment is configured so that the angle $\alpha 1$ formed between the optical axis of the light emitted from the light emitting unit and the medium (hereinafter, referred to as a detection angle) when the light emitting unit opposes the medium accommodated in the lower medium accommodation unit is closer to the right angle than the angle α2 formed between the optical axis and the medium when the light emitting unit opposes the medium accommodated in the upper medium accommodation unit. That is, a disadvantageous point is corrected to an advantageous point by causing the disadvantageous point from a viewpoint of the detection distance (case of the lower medium accommodation unit) to be the advantageous point in viewpoint of the detection angle, and by causing the advantageous point from a viewpoint of the detection distance (case of the upper medium accommodation unit) to be the disadvantageous point in viewpoint of the detection angle. In this manner, regardless of the angle of the swing member, it is possible to properly detect the presence or absence of the medium in both of the upper medium accommodation unit and the lower medium accommodation unit.

In the recording apparatus, the medium detection unit may be configured to have an optical sensor that includes a light emitting unit and a light receiving unit which oppose the medium accommodated in the medium accommodation unit. The light emitting unit may adjust light emitting intensity. A controller which adjusts the light emitting intensity of the light emitting unit may adjust the light emitting intensity according to a posture of the feeding member.

In this case, the light emitting intensity of the light emitting unit is adjusted according to the posture of the swing member. Therefore, it is possible to perform proper detection (detect the presence or absence of the medium) by adjusting the light emitting intensity according to the angle formed between the medium and the optical axis.

In the recording apparatus, the medium detection unit may be configured to have an optical sensor that includes a light emitting unit and a light receiving unit which oppose the medium accommodated in the medium accommodation unit. The feeding member may have a pendulum which maintains a predetermined posture regardless of a posture of the feeding member. The pendulum may have the optical sensor.

In this case, the angle formed between the optical axis of the light emitted from the light emitting unit and the medium when the light emitting unit opposes the medium accommodated in the medium accommodation unit can be maintained to be a predetermined angle regardless of a posture of the swing member. Therefore, it is possible to maintain the angle formed between the optical axis and the medium to be the optimum angle (for example, the right angle), and thus it is possible to perform proper detection (detect the presence or absence of the medium).

In the recording apparatus, the medium detection unit may be connected to a circuit board which is arranged at a position separated from the feeding member by a signal line. The signal line may be wired to a position which is shielded from a transport route through which the medium is transported.

In this case, the signal line which connects the medium detection unit and the circuit board is wired to the position which is shielded from the transport route through which the medium is transported. Therefore, it is possible to prevent a user's finger from coming into contact with the signal line and being caught on the signal line during jam processing.

In the recording apparatus, the signal line may be arranged in a region facing the medium accommodation unit and at the position which is shielded from the transport route.

In this case, the signal line is arranged in the region facing the medium accommodation unit and at the position which is shielded from the transport route. Therefore, it is possible to prevent the user's finger from coming into contact with the signal line and being caught on the signal line during the jam processing, or during setting work for the medium.

In the recording apparatus, the feeding member may have a feeding roller and a gear group which transmits drive force to the feeding roller. In the feeding member, the medium detection unit may be disposed closer to the circuit board than the gear group.

In this case, in the swing member, the medium detection unit is disposed closer to the circuit board than the gear group. Therefore, it is possible to wire the signal line without bypassing the gear group, that is, it is possible to further shorten the length of the signal line.

According to another aspect of the invention, there is provided a recording apparatus including: a recording unit that performs recording on a medium; a medium accommodation unit that accommodates the medium; a feeding member that is swingable and feeds the medium from the medium accommodation unit; an interlocking member that is operated by being interlocked with the feeding member; and a medium detection unit that is disposed in the interlocking member and detects the presence or absence of the medium inside the medium accommodation unit.

According to further another aspect of the invention, there is provided a medium feeding device including: a medium accommodation unit that accommodates a medium; a feeding member that is swingable and feeds the medium from the medium accommodation unit; and a medium detection unit that is disposed in the feeding member and detects the presence or absence of the medium inside the medium accommodation unit.

According to still further another aspect of the invention, there is provided a medium feeding device including: a medium accommodation unit that accommodates a medium; a feeding member that is swingable and feeds the medium from the medium accommodation unit; an interlocking member that is operated by being interlocked with the feeding member; and a medium detection unit that is disposed in the interlocking member and detects the presence or absence of the medium inside the medium accommodation unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described with reference to the drawings. However, the invention is not limited to embodiments to be described below. The invention can be modified in various ways within the scope of the invention disclosed herein. Assuming that the modifications are included in the scope of the invention, an embodiment of the invention will be described herein.

Figure 1:
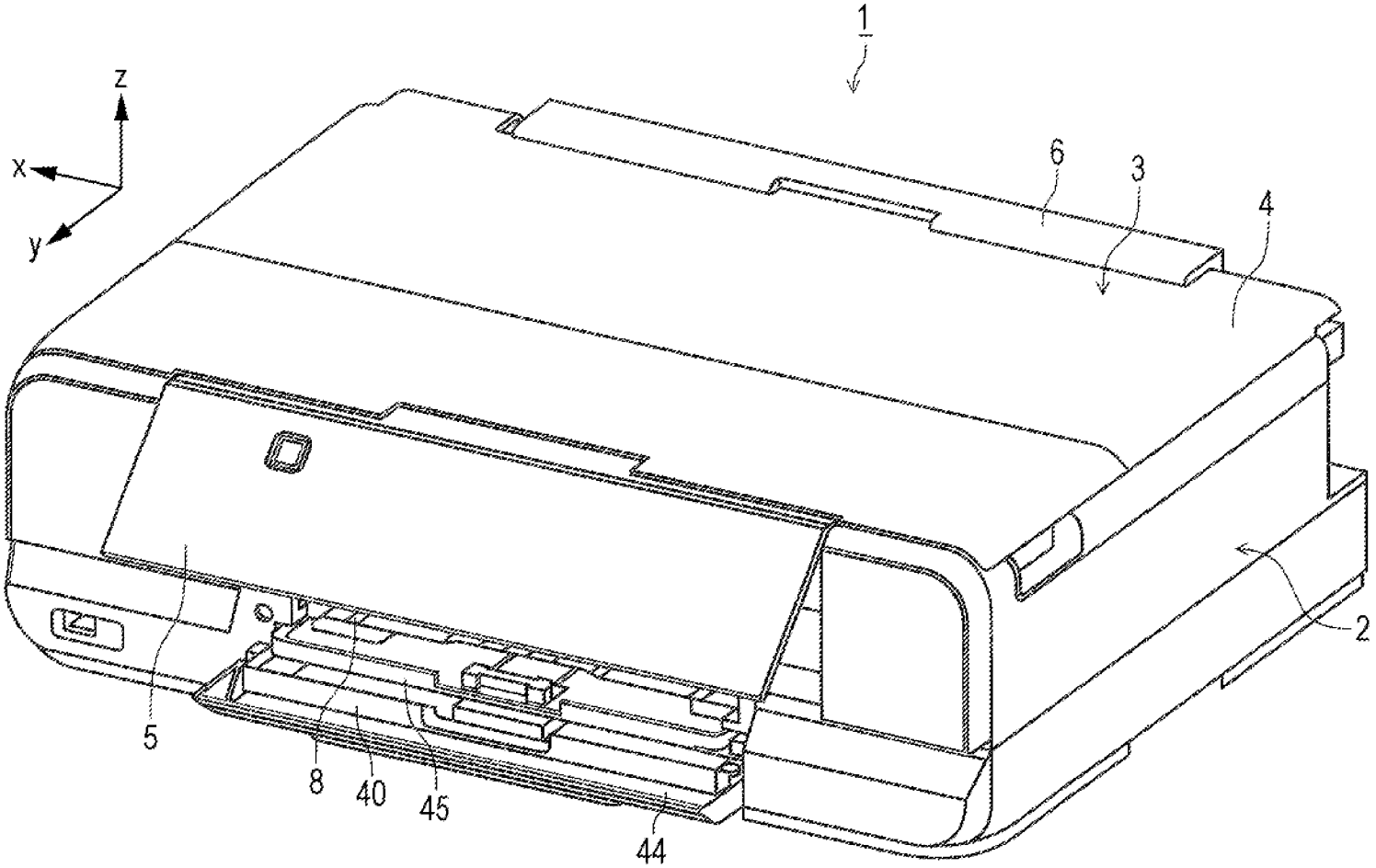
FIG. 1 is an external perspective view of a printer according to an aspect of the invention.
Figure 2:
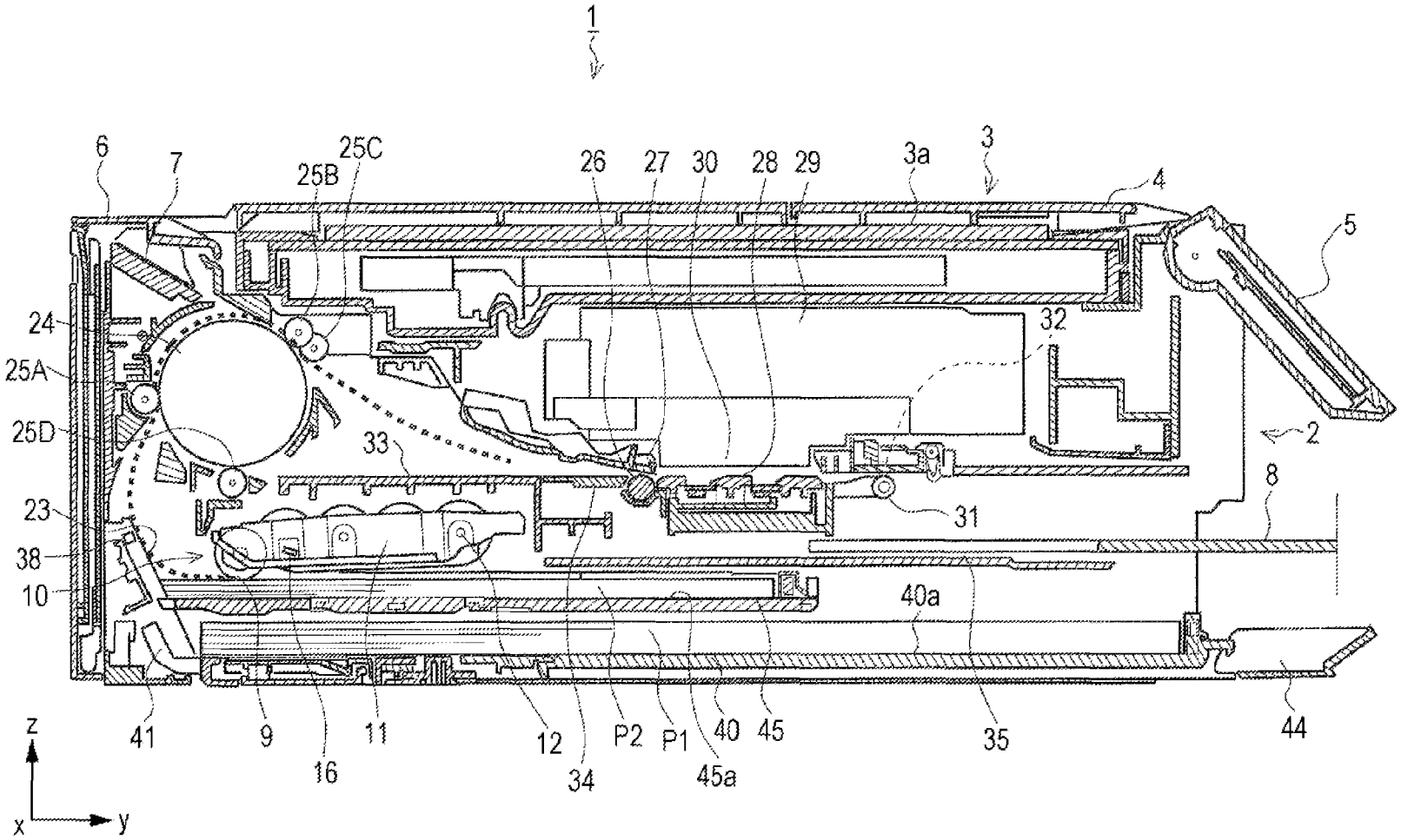
FIG. 2 is a side cross-sectional view illustrating a sheet transport route of the printer according to an aspect of the invention.
Figure 3:
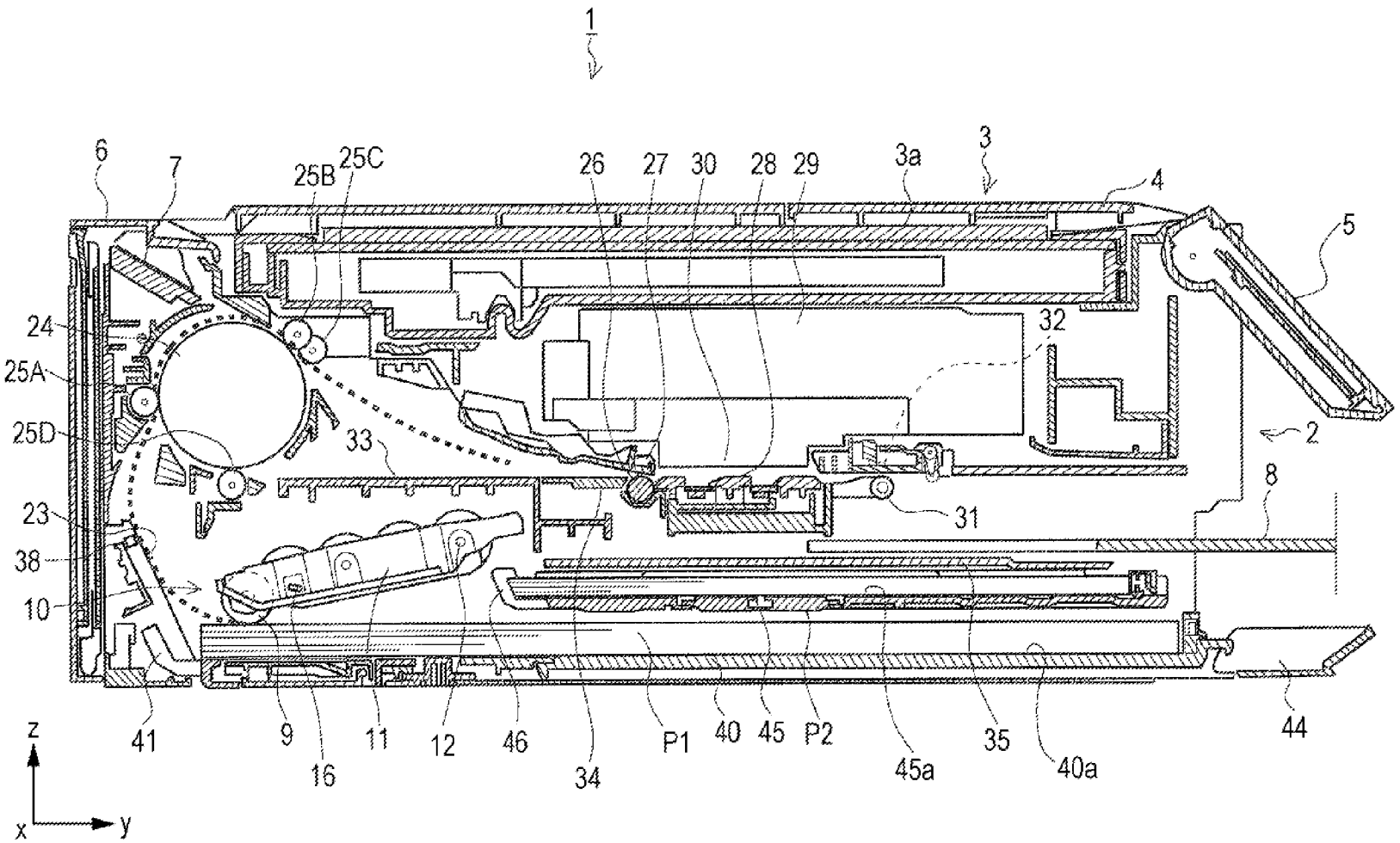
FIG. 3 is a side cross-sectional view illustrating a sheet transport route of the printer according to an aspect of the invention.
Figure 4:
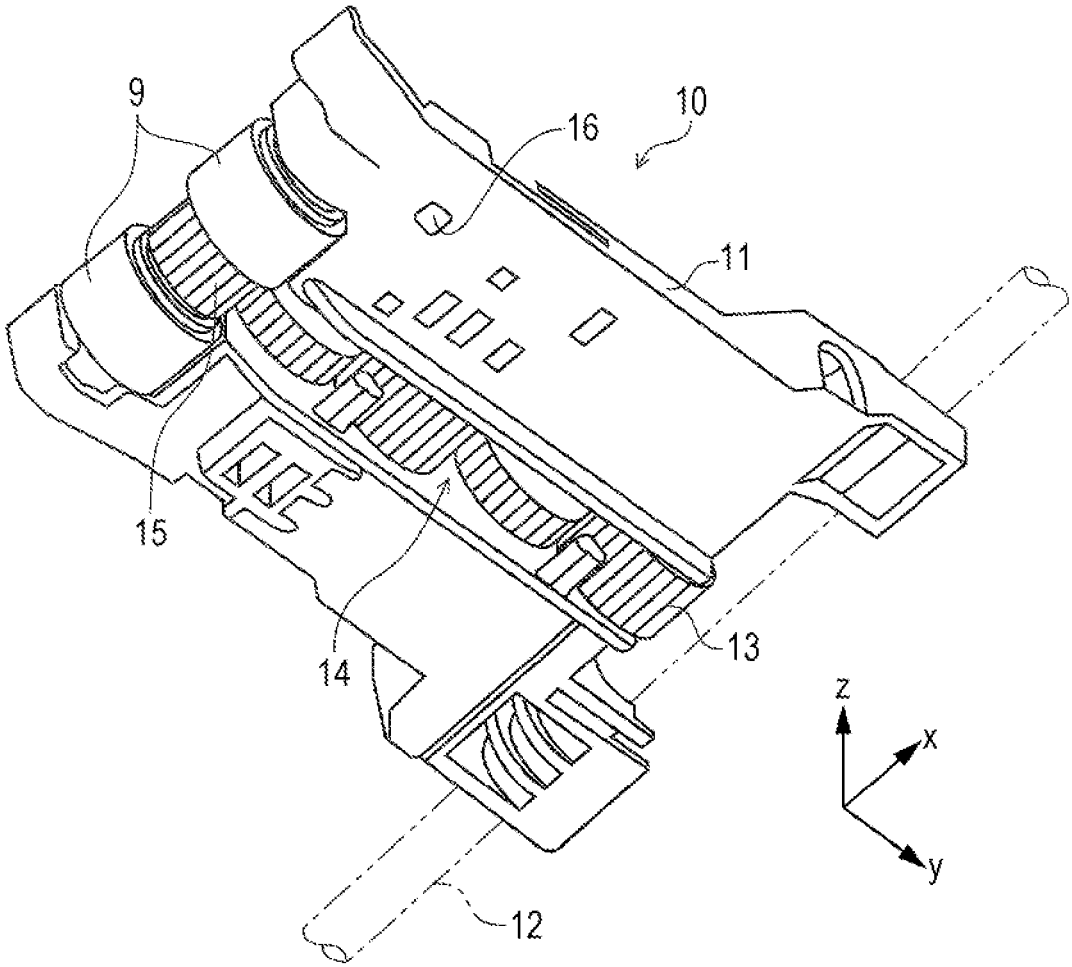
FIG. 4 is a perspective view of a roller support member assembly.
Figure 5A:
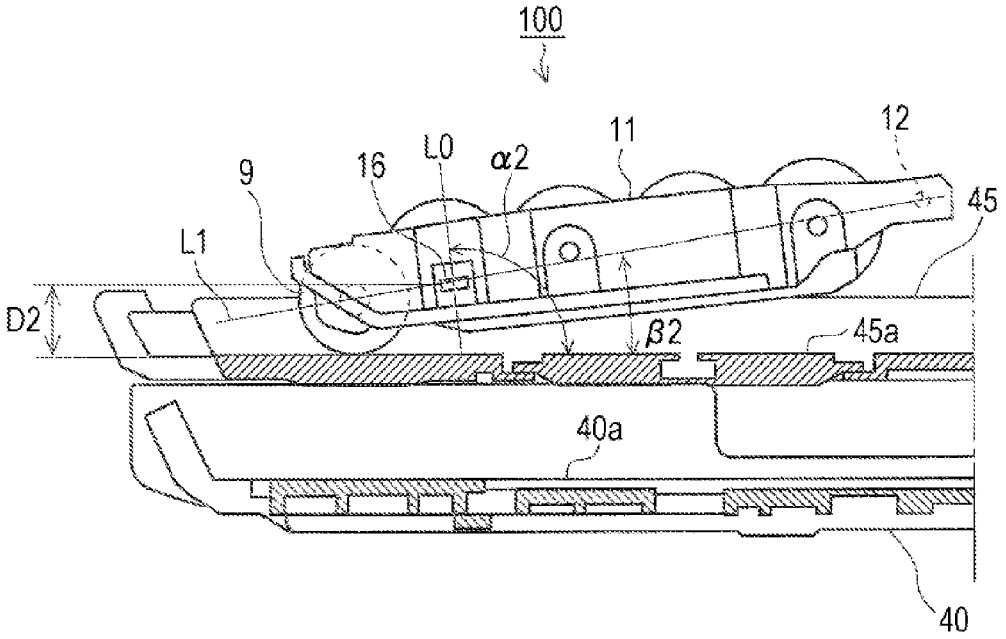
FIG. 5A is a side view of a feeding device which illustrates a state of feeding a sheet from an upper tray.
Figure 5B:
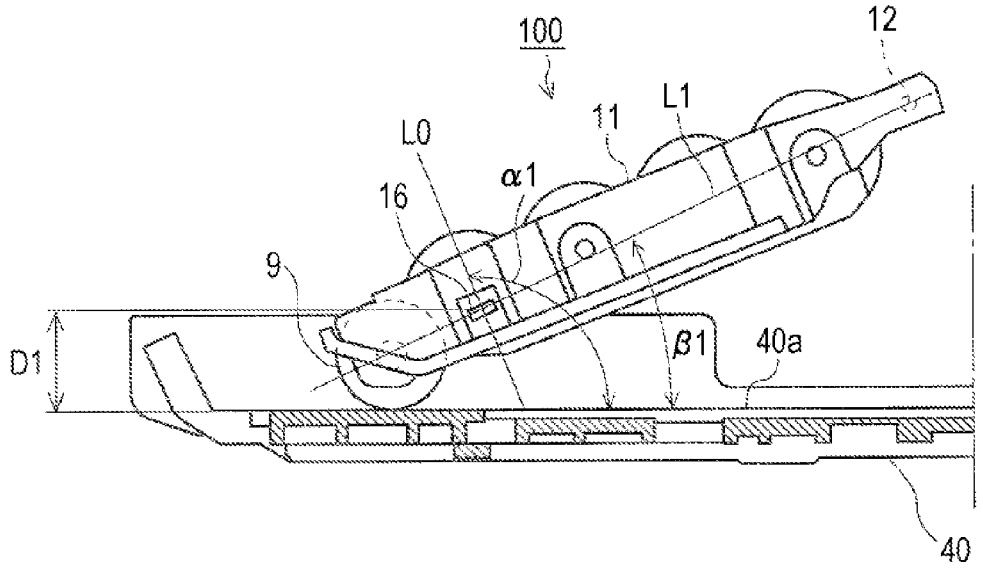
FIG. 5B is a side view of the feeding device which illustrates a state of feeding the sheet from a lower tray, respectively (illustration of the problem).
Figure 18:
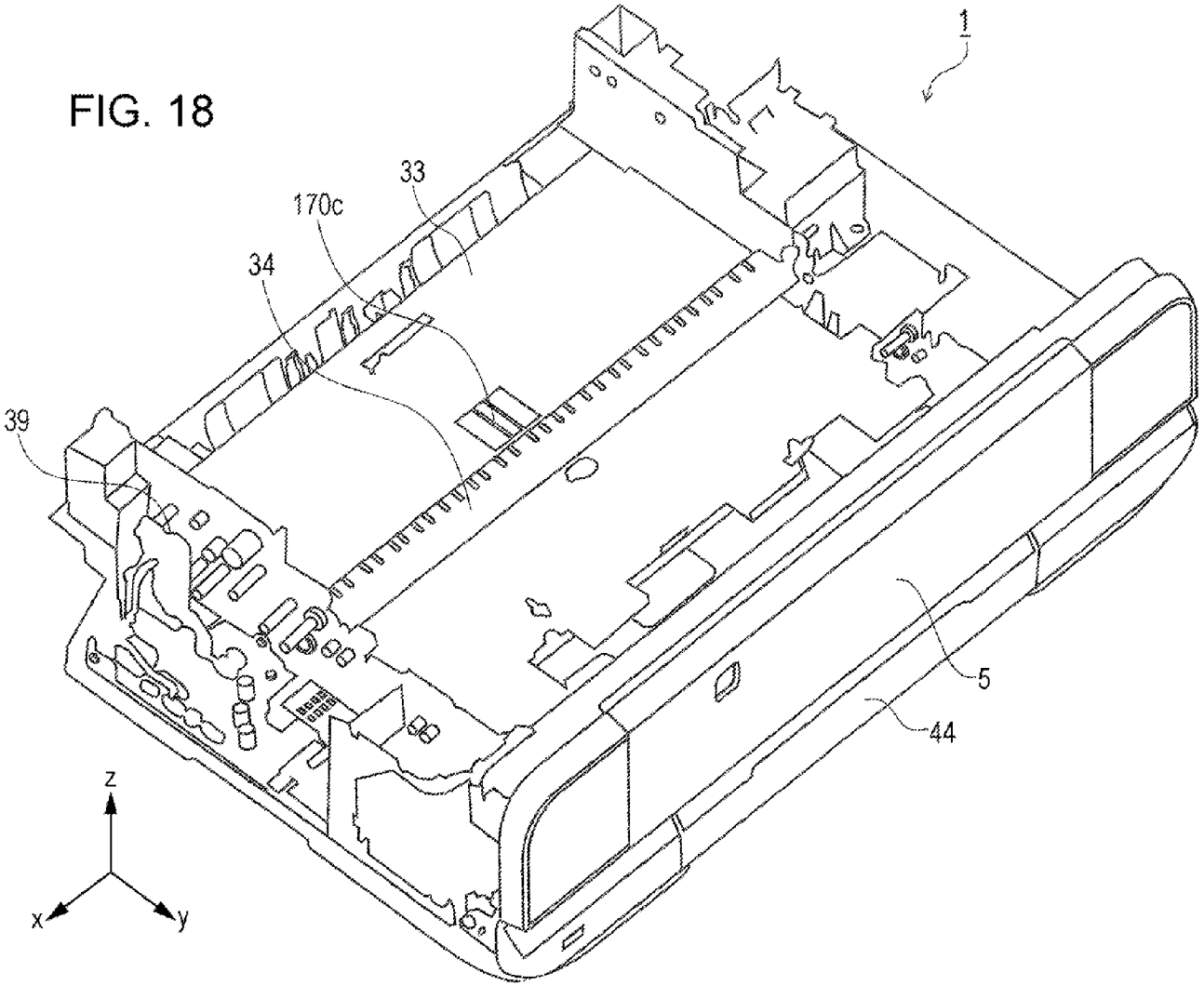
FIG. 18 is a perspective view from above, in which some configurations of a printer are appropriately detached from the printer (second example).
Figure 19:
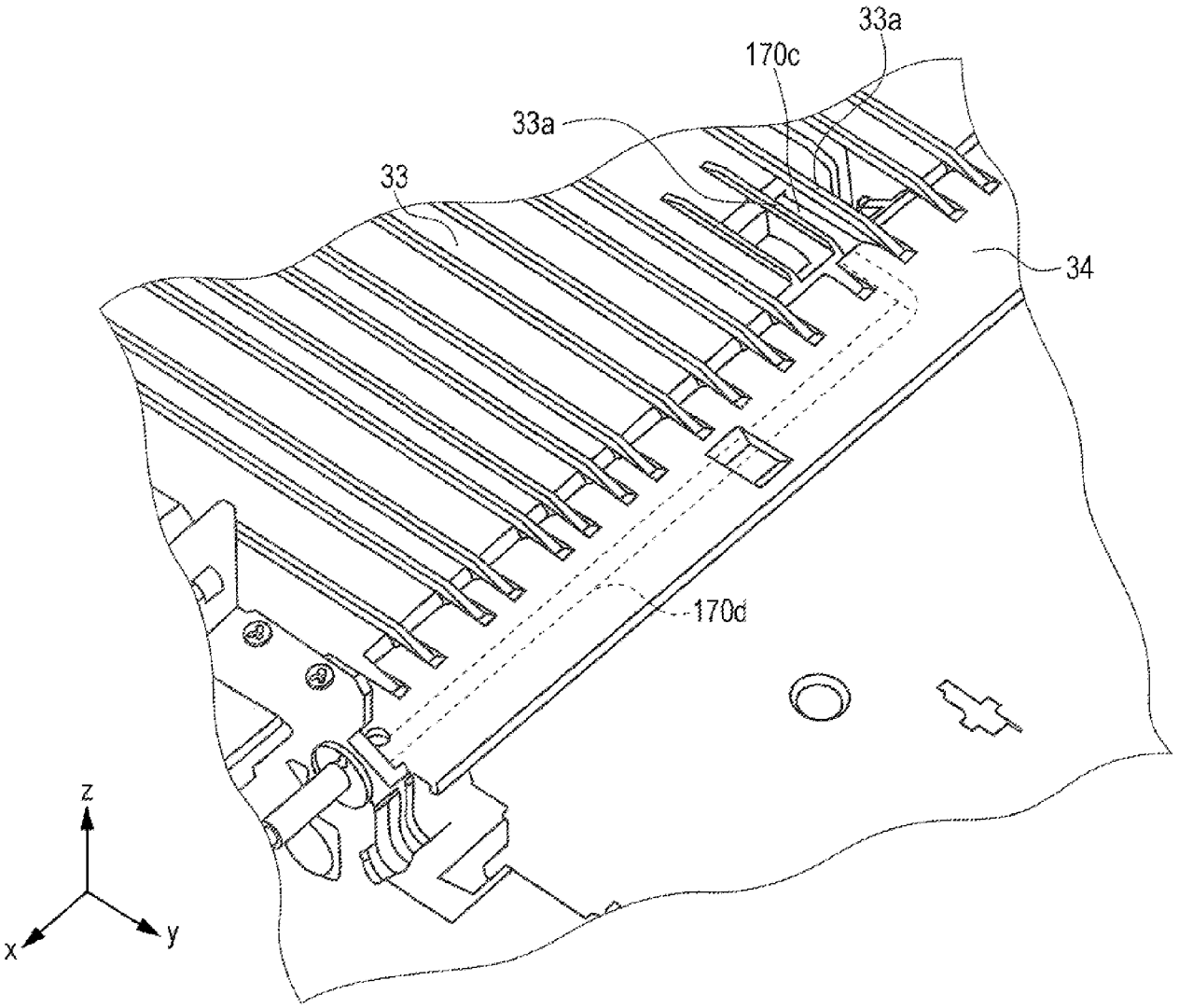
FIG. 19 is a partial enlarged view of FIG. 18 (second example).
Figure 20:
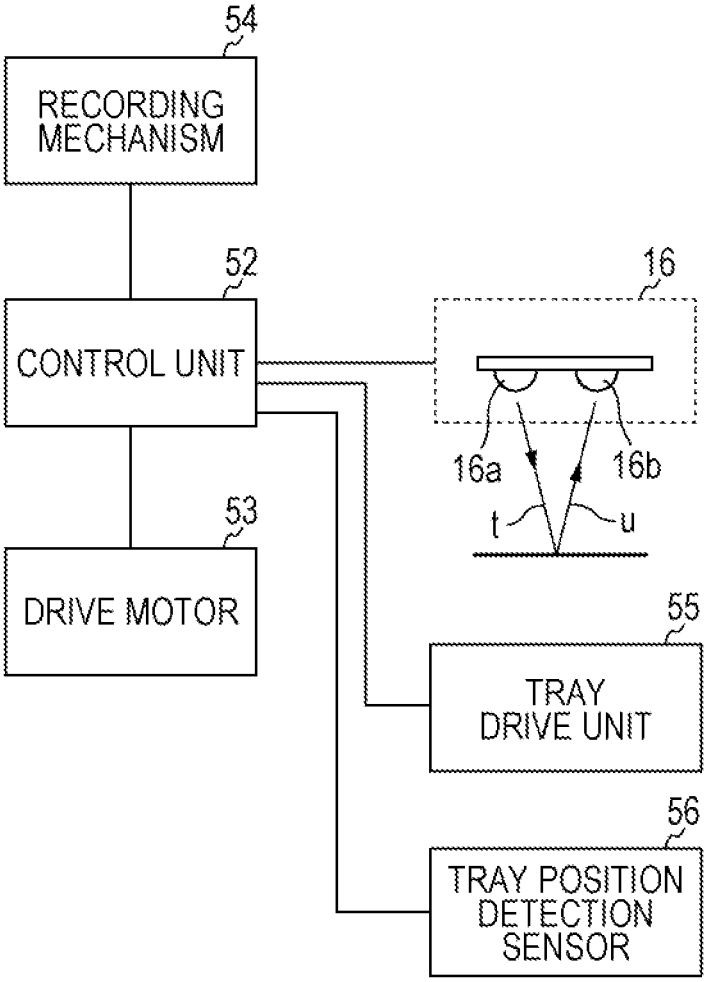
FIG. 20 is a block diagram partially illustrating a control system of the printer according to the invention.

FIG. 1 is an external perspective view of a printer 1 according to the invention. FIGS. 2 and 3 are side cross-sectional views illustrating a sheet transport route of the printer 1. FIG. 4 is a perspective view of a roller support member assembly (hereinafter, referred to as an "assy") 10. FIGS. 5A to 10A are side cross-sectional views illustrating a state where a sheet is fed from an upper tray 45, and FIGS. 5B to 10B are side cross-sectional views illustrating a state where a sheet is fed from a lower tray 40. Among the drawings, FIGS. 5A and 5B are views for illustrating the problem of the invention, and FIGS. 6A to 11 respectively illustrate first to sixth embodiments. Furthermore, FIG. 20 is a block diagram partially illustrating a control system of the printer 1. FIGS. 12 to 19 will be described later.

In each drawing, an x-y-z coordinate system represents a direction. A z-direction represents a vertical direction (height direction of an apparatus), a y-direction represents a sheet transport and discharge direction (forward and rearward direction of the apparatus), and an x-direction represents a sheet width direction (rightward and leftward direction of the apparatus).

1. Entire Configuration of Printer

Hereinafter, an entire configuration of the printer 1 according to an embodiment of the recording apparatus of the invention will be schematically described with reference to FIGS. 1 to 3. The printer 1 includes a scanner unit 3 on an upper portion of an apparatus body (recording unit) 2 which performs ink jet recording on a recording sheet serving as an example of a medium. That is, the printer 1 is configured to serve as a multifunction machine including a scanner function in addition to an ink jet recording function.

The scanner unit 3 is disposed so as to be rotatable with respect to the apparatus body 2. The rotation enables the scanner unit 3 to be in a closed state (refer to FIG. 1) and in an opened state (not illustrated).

An upper cover 4 in the scanner unit 3 is openable and closeable. When the cover 4 is opened, a manuscript table 3*a* (refer to FIGS. 2 and 3) of the scanner unit 3 is shown.

A reference numeral 5 on a front surface of the apparatus is an operation panel including a power button, operation buttons for performing various printing settings and recording operations, and a display unit for a preview display of printing settings and printing images.

In addition, a reference numeral 44 on the front surface of the apparatus is an openable and closeable cover disposed in a lower tray 40. As illustrated in FIG. 1, when the cover 44 is opened, the lower tray 40 and an upper tray 45 which configure a medium accommodation unit, and a discharge sheet receiving tray 8 are exposed in this configuration.

The discharge sheet receiving tray 8 is disposed so that a motor (not illustrated) can switch between a state of being accommodated in the apparatus body 2 (refer to FIG. 1) and a state of being protruded forward from the apparatus body 2 (refer to FIGS. 2 and 3). The discharge sheet receiving tray 8, when in the state of being protruded forward from the apparatus body 2, can receive a recording sheet which is recorded and discharged.

Figure 14:
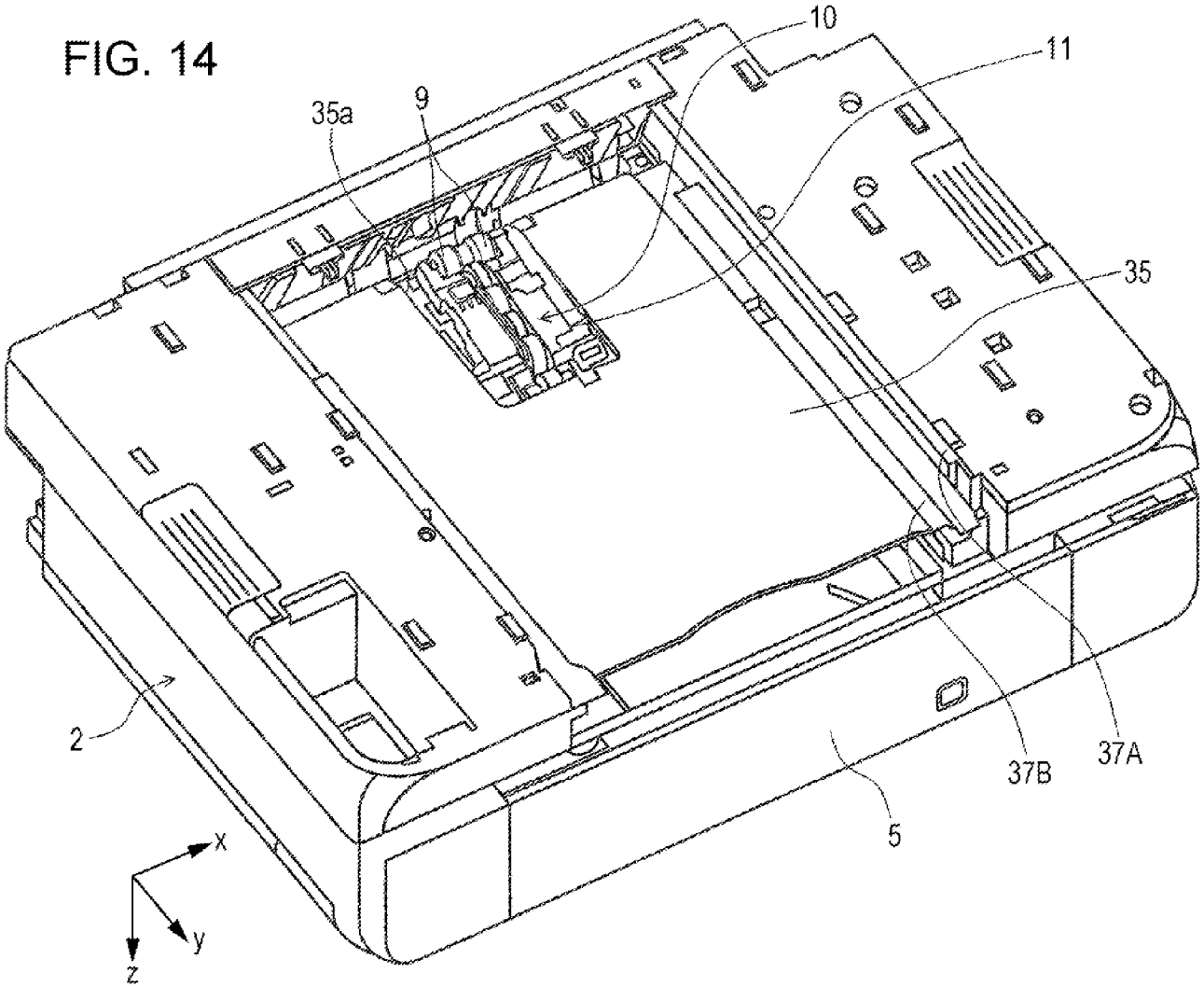
FIG. 14 is a perspective view of a bottom surface of an apparatus in a state where an upper tray and a lower tray are detached from the apparatus (first example).

The lower tray 40 and the upper tray 45, all of which can accommodate multiple recording sheets are medium accommodation units that accommodate a medium. That is, the medium accommodation unit of the printer 1 is configured to have multiple medium accommodation trays. The lower tray 40 and the upper tray 45 disposed above the lower tray 40 are respectively and independently attachable to and detachable from the apparatus body 2. In addition, even when one side is not attached, if the other side is attached, the recording sheet can be fed from the attached tray. A reference numeral 37A in FIG. 14 is a guide rail which guides and supports the lower tray 40 in an attaching/detaching direction. A reference numeral 37B is a guide rail which guides and supports the upper tray 45 in the attaching/detaching direction.

The upper tray 45 is disposed so as to be slidingly displaced by a tray drive unit 55 (refer to FIG. 20), between a retreat position (refer to FIG. 3) and an abutting position (refer to FIG. 2) in a state of being attached to the apparatus body 2. For example, if a printing job is carried out to feed the sheet from the upper tray 45, a control unit 52 (refer to FIG. 20) of the printer 1 causes the upper tray 45 to be positioned at the abutting position illustrated in FIG. 2. In addition, if a printing job is carried out to feed the sheet from the lower tray 40, the control unit 52 of the printer 1 causes the upper tray 45 to be positioned at the retreat position illustrated in FIG. 3. The tray drive unit 55 is a drive mechanism including a motor, but a structure thereof is omitted in the illustration.

The printer 1 has a tray position detection sensor 56 (refer to FIG. 20) which detects a slide position of the upper tray 45. Based on signal information transmitted from the tray position detection sensor 56, the control unit 52 can understand whether the upper tray 45 is either in a position where the feeding is available or in the retreat position. However, in the embodiment, the upper tray 45 is driven by a motor. Accordingly, based on a motor drive direction, it is also possible to understand where the abutting position of the upper tray 45 is positioned (either in the position where the feeding is available or in the retreat position) according to the increase in the motor current value.

Next, a reference numeral 6 at a rear upper portion of the apparatus body 2 is a manual feeding cover which is openable and closeable. When the manual feeding cover 6 is opened, the recording sheet can be manually fed by using a manual feeding tray 7 (refer to FIGS. 2 and 3).

Next, a sheet transport route of the printer 1 will be described with reference to FIGS. 2 and 3. The printer 1 according to the embodiment includes the above-described lower tray 40 and upper tray 45 in a bottom portion of the apparatus. The recording sheet is fed one by one from the lower tray 40 or the upper tray 45. As described above, the upper tray 45 is slid (displaced) between the abutting position, that is, the position where the feeding is available (refer to FIG. 2), and the retreat position (refer to FIG. 3).

In FIGS. 2 and 3, the sheet accommodated in the lower tray 40 is illustrated by a reference numeral P1 and the sheet accommodated in the upper tray 45 is illustrated by a reference numeral P2, respectively (hereinafter, referred to as a "sheet P" when it is not necessary to particularly distinguish the sheets from each other).

A feeding roller (also referred to as a pickup roller) 9 configuring a feeding unit, which is rotationally driven by a drive motor 53 (refer to FIG. 20), is disposed in a roller support member 11 serving as a swing member which swings around a pivot shaft 12 or a feeding member. When the upper tray 45 is in the retreat position (refer to FIG. 3), the feeding roller 9 is rotated by coming into contact with the uppermost sheet P1 accommodated in the lower tray 40. In this manner, the uppermost sheet P1 is fed from the lower tray 40.

In addition, when the upper tray 45 is in the abutting position (position where the feeding is available: refer to FIG. 2), the feeding roller 9 is rotated by coming into contact with the uppermost sheet P2 accommodated in the upper tray 45. In this manner, the uppermost sheet P2 is fed from the upper tray 45.

In the embodiment, the pivot shaft 12 configures a swing shaft of the roller support member 11, and is rotated by receiving power of the drive motor 53 (refer to FIG. 20). In this manner, as illustrated in FIG. 4, the pivot shaft 12 transmits the power from a transmitting gear 13 disposed in the pivot shaft 12 via a gear train 14 to a transmitted gear 15 disposed integrally with the feeding roller 9. That is, the pivot shaft 12 transmits the power for rotating the feeding roller 9, and also transmits the power for swinging the roller support member 11.

In the embodiment, the feeding rollers 9 are respectively disposed in both sides by interposing the transmitted gear 15 therebetween. Since the multiple feeding rollers 9 are disposed, it is possible to reliably feed the sheet P. The roller support member 11, the gear train 14, the transmitted gear 15, the feeding rollers 9 and an optical sensor 16 (to be described later) are assembled to configure a roller support member assy 10.

The optical sensor 16 (refer to FIG. 4) serving as a medium detection unit which detects the presence or absence of the sheet P in each tray of the lower tray 40 and the upper tray 45 is disposed in the roller support member 11. The optical sensor 16 is configured to include a light emitting unit 16*a* and a light receiving unit 16*b* (refer to FIG. 20). The light emitting unit 16*a* emits detection light t to the sheet P accommodated in each tray, and out of the emitting light, the light receiving unit 16*b* receives a component u reflected from the sheet P of each tray or a bottom surface of each tray.

The control unit 52 of the printer 1 can detect the presence or absence of the sheet P in each tray by receiving a signal indicating light receiving intensity in the light receiving unit 16*b* from the optical sensor 16. For this reason, a portion opposing the optical sensor 16 in a bottom surface (bottom surfaces 40*a* and 45*a*) of each tray is black-colored, for example, so as to have reflectivity which is significantly different from that of the sheet P.

The invention is characterized by the arrangement of the optical sensor 16 for reliably detecting the presence or absence of the sheet P in each tray. This point will be described in detail later.

Here, as illustrated in FIGS. 2 and 3, the optical sensor 16 is disposed in a region where the lower tray 40 and the upper tray 45 are overlapped with each other, that is, in a region the lower tray 40 and the upper tray 45 are vertically overlapped with each other. Then, by using a sliding operation of the upper tray 45, the optical sensor 16 can select the opposing tray between the lower tray 40 and the upper tray 45. Accordingly, it is not necessary to dispose a detection unit for each of the lower tray 40 and the upper tray 45. Therefore, by using one optical sensor 16, it is possible to detect the presence or absence of the sheet P in multiple trays, that is, in the lower tray 40 and the upper tray 45, and thus it is possible to avoid the cost increasing.

The invention is not intended to exclude a case of disposing detection units other than the optical sensor 16. Furthermore, even when the detection units are disposed, insofar as at least one optical sensor 16 can detect the presence or absence of the sheet P in multiple trays, the case is within the applicable scope of the invention.

In addition, in the embodiment, the optical sensor 16 is swingable in an upper side of the lower tray 40 and the upper tray 45, and is disposed in the roller support member 11 serving as the swing member which supports the feeding roller 9. Accordingly, a height position of the optical sensor 16 varies depending on the number of sheets accommodated in each tray, that is, a distance between the optical sensor 16 and the sheet P is adjusted. Therefore, it is possible to more properly detect the presence or absence of the sheet P. The roller support member 11 is a configuring member shared by both of the feeding roller 9 and the optical sensor 16. For this reason, it is not necessary to respectively dispose dedicated swing members for the feeding roller 9 and the optical sensor 16. Therefore, it is possible to avoid the cost increasing.

Next, as illustrated in FIGS. 2 and 3, a separation slope 23 is disposed at a position opposing a front end of the lower tray 40 and the upper tray 45 in the apparatus body 2. In a state where the lower tray 40 is attached, a stopper 41 disposed in the front end of the lower tray 40 enters the rear side (left side in FIG. 3) deeper than the separation slope 23, and a leading edge of the sheet P accommodated in the lower tray 40 can be in contact with the separation slope 23.

In the upper tray 45, in a state where the upper tray 45 is positioned at the position where the feeding is available, a stopper 46 disposed in the front end of the upper tray 45 enters the rear side deeper than the separation slope 23, and a leading edge of the sheet P accommodated in the upper tray 45 can be in contact with the separation slope 23.

Then, the sheet P fed from the lower tray 40 or the upper tray 45 advances toward a downstream side while the leading edge of the sheet P is in contact with the separation slope 23. In this manner, the uppermost sheet P to be fed and the sheets P to be subsequently fed are separated from each other.

A sheet detection sensor 38 is disposed at the position of the separation slope 23 in the sheet feeding route. This position enables the detection of the leading edge of the sheet P fed from the lower tray 40 and the upper tray 45. Accordingly, regardless of a difference in a length of the feeding route which is caused by different trays, or a difference in the length of the feeding route which is caused by the different number of accommodated sheets, that is, regardless of the different length of the feeding route depending on conditions, it is possible to understand the position of the leading edge of the sheet P. This enables more proper feeding control.

An intermediate roller 24 which is rotationally driven by a motor (not illustrated) is disposed in a tip of the separation slope 23. The sheet P is bent and reversed to move toward a front side of the apparatus by the intermediate roller 24. Reference numerals 25A, 25B and 25C are driven rollers which can be rotationally driven. The sheet P is nipped by at least the driven roller 25A and the intermediate roller 24, or is nipped by the driven roller 25B and the intermediate roller 24, thereby being sent to the downstream side.

A transport driving roller 26 which is rotationally driven by a motor (not illustrated) and a transport driven roller 27 which is rotationally driven by coming into contact with the transport driving roller 26 are disposed in a tip of the intermediate roller 24. These rollers cause the sheet P to be sent to a position below a recording head 30 configuring a recording unit.

The recording head 30 which ejects an ink is disposed in a bottom portion of a carriage 29. The carriage 29 is driven so as to reciprocate in a main scanning direction (forward and rearward direction of the paper surface in FIGS. 2 and 3) by a motor (not illustrated).

A support member 28 is disposed in a position opposing the recording head 30. The support member 28 defines a distance between the sheet P and the recording head 30. Then, a discharge driving roller 31 which is rotationally driven by a motor (not illustrated) and a discharge driven roller 32 which is rotationally driven by coming into contact with the discharge driving roller 31 are disposed in the downstream side of the support member 28. These rollers cause the sheet P which is recorded by the recording head 30 to be discharged toward the above-described discharge sheet receiving tray 8.

The above-described transport driving roller 26, carriage 29, recording head 30, discharge driving roller 31 and control targets thereof configure a recording mechanism 54 illustrated in FIG. 20, which is controlled by the control unit 52.

In FIGS. 2 and 3, a guide member illustrated by a reference numeral 33 is disposed below the intermediate roller 24. This guide member 33 forms the sheet transport route between the intermediate roller 24 and the transport driving roller 26. In addition, a reference numeral 34 represents a guide member which forms the sheet transport route between the guide member 33 and the transport driving roller 26. A reference numeral 25D represents a driven roller in which the sheet P switched back from the transport driving roller 26 to an upstream side (left side in FIGS. 2 and 3) is nipped between the intermediate roller 24 and the driven roller for two-sided printing.

2. First Embodiment of Roller Support Member Assy

Next, a first embodiment of the roller support member assy for reliably detecting the presence or absence of the sheet P in each tray will be described. First, a technical task associated with a case where the optical sensor 16 is disposed in the roller support member 11 which supports the feeding roller 9 will be described with reference to FIGS. 5A and 5B.

In FIGS. 5A and 5B, a straight line illustrated by a reference numeral L0 represents an optical axis of the optical sensor 16, and a straight line illustrated by a reference numeral L1 represents a line connecting a swing center of the roller support member 11 and a rotation center of the feeding roller 9, respectively. In addition, a reference numeral $\alpha 1$ represents an angle formed between the optical axis L0 and the tray bottom surface 40*a* or the sheet P in a case of the lower tray 40 (hereinafter, referred to as a "detection angle $\alpha 1$"), and a reference numeral $\alpha 2$ represents an angle formed between the optical axis L0 and the tray bottom surface 45*a* or the sheet P in a case of the upper tray 45 (hereinafter, referred to as a "detection angle $\alpha 2$"), respectively.

In addition, a reference numeral $\beta 1$ represents an angle formed between the line L1 and the tray bottom surface 40*a* or the sheet P in a case of feeding the sheet P from the lower tray 40, and a reference numeral $\beta 2$ represents an angle formed between the line L1 and the tray bottom surface 45*a* or the sheet P in a case of feeding the sheet P from the upper tray 45, respectively. In the description, the angle $\beta 1$ represents the angle formed between the roller support member 11 and the tray bottom surface 40*a* or the sheet P, and the angle $\beta 2$ represents the angle formed between the roller support member 11 and the tray bottom surface 45*a* or the sheet P.

Furthermore, a reference number D1 represents a distance between the optical sensor 16 and the sheet P in a case of the lower tray 40 (hereinafter, referred to as a "detection distance D1"), and a reference number D2 represents a distance between the optical sensor 16 and the sheet P in a case of the upper tray 45 (hereinafter, referred to as a "detection distance D2").

In FIGS. 5A and 5B, a reference numeral 100 is given to the roller support member assy so as to be distinguished from the roller support member assy according to the invention. The optical sensor 16 in the roller support member assy 100 illustrated in FIGS. 5A and 5B is arranged in substantially parallel with the roller support member 11, that is, is disposed so as to be substantially orthogonal to the optical axis L0 and the line L1. When the optical sensor 16 is disposed in the roller support member 11, the optical sensor 16 is generally disposed in this way.

Here, the detection angle $\alpha 1$, the angle $\beta 1$ and the detection distance D1 occupy a predetermined range between a state where the maximum number of sheets is accommodated in the lower tray 40 and a case of running-out of the sheet. Similarly, the detection angle $\alpha 2$, the angle $\beta 2$ and the detection distance D2 occupy a predetermined range between a state where the maximum number of sheets is accommodated in the upper tray 45 and a case of running-out of the sheet.

However, as is apparent from the comparison between FIGS. 5A and 5B, the angle $\beta 2$ in a case of feeding the sheet P from the upper tray 45 is larger than the angle $\beta 1$ in a case of feeding the sheet P from the lower tray 40. For this reason, regardless of the number of sheets accommodated in each tray, the result is $\beta 1 > \beta 2$. Then, regardless of the number of sheets accommodated in each tray, the result is detection distance D1>detection distance D2.

In a case of FIGS. 5A and 5B, the angle α2 is closer to the right angle than the angle α1. That is, the angle formed between the optical axis L0 and the sheet P in a case of feeding the sheet P from the upper tray 45 is closer to the right angle than the angle formed between the optical axis L0 and the sheet P in a case of feeding the sheet P from the lower tray 40. Therefore, from a viewpoint of the detection angle, the case of the upper tray 45 is more advantageous than the case of the lower tray 40.

In contrast, the detection distance D2 is shorter than the detection distance D1. Accordingly, from a viewpoint of either the detection angle or the detection distance, the case of the upper tray 45 is more advantageous than the case of the lower tray 40. That is, in other words, as compared to the case of the upper tray 45, the light receiving intensity in the optical sensor 16 is weaker in the case of the lower tray 40. Therefore, the case of the lower tray 40 is disadvantageous from a viewpoint of detecting the presence or absence of the sheet P.

Each embodiment of the invention which is to be described below is to solve this problem, and is configured to avoid that either the lower tray 40 or the upper tray 45 is significantly disadvantageous from the viewpoint of the detection angle and the detection distance.

Figure 6A:
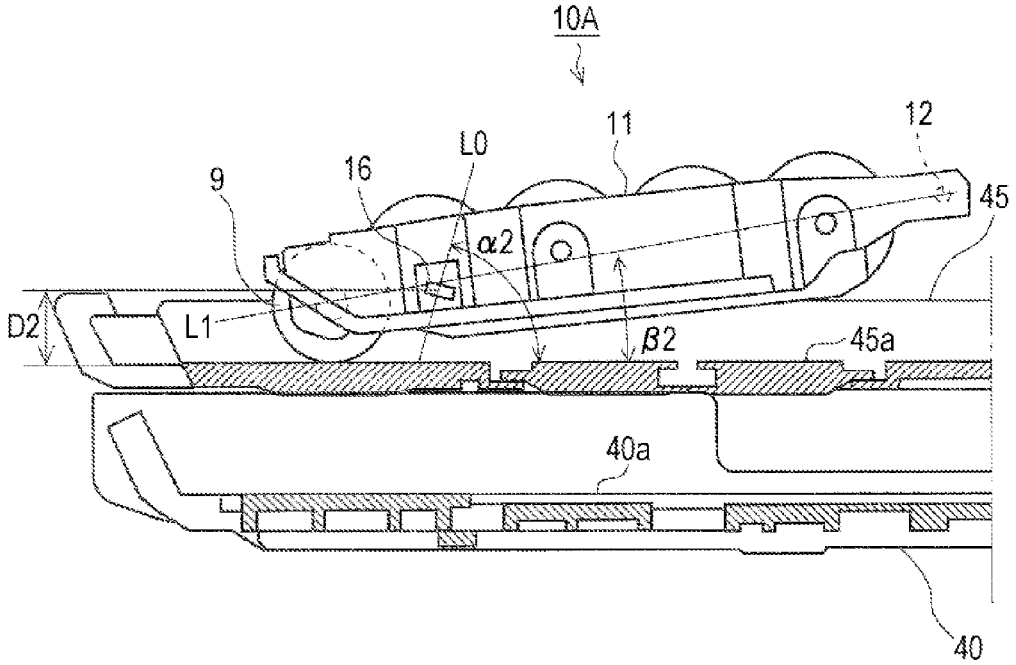
FIG. 6A is a side view of a feeding device which illustrates a state of feeding a sheet from an upper tray.
Figure 6B:
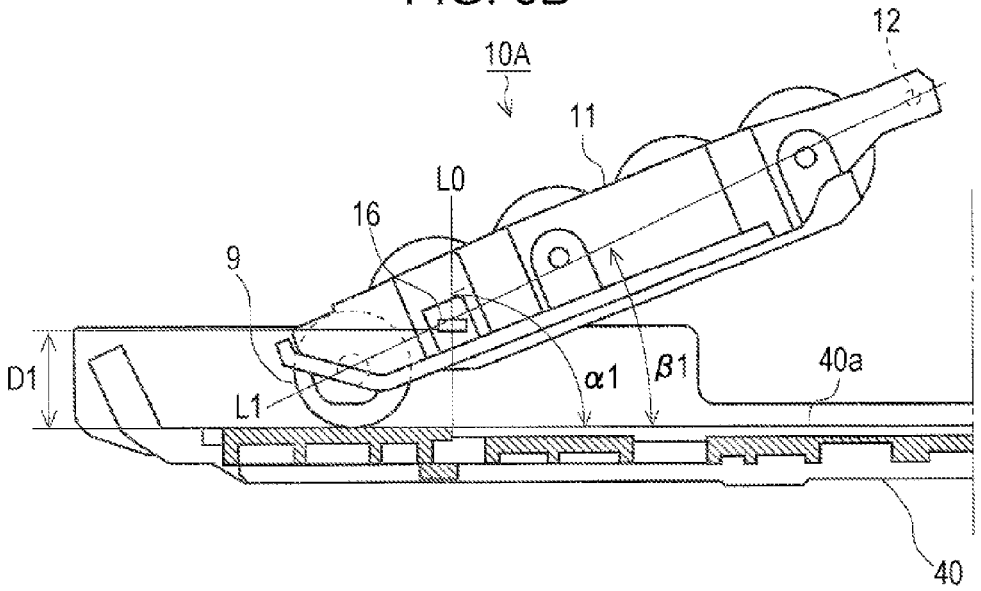
FIG. 6B is a side view of the feeding device which illustrates a state of feeding the sheet from a lower tray, respectively (first embodiment).
Figure 7A:
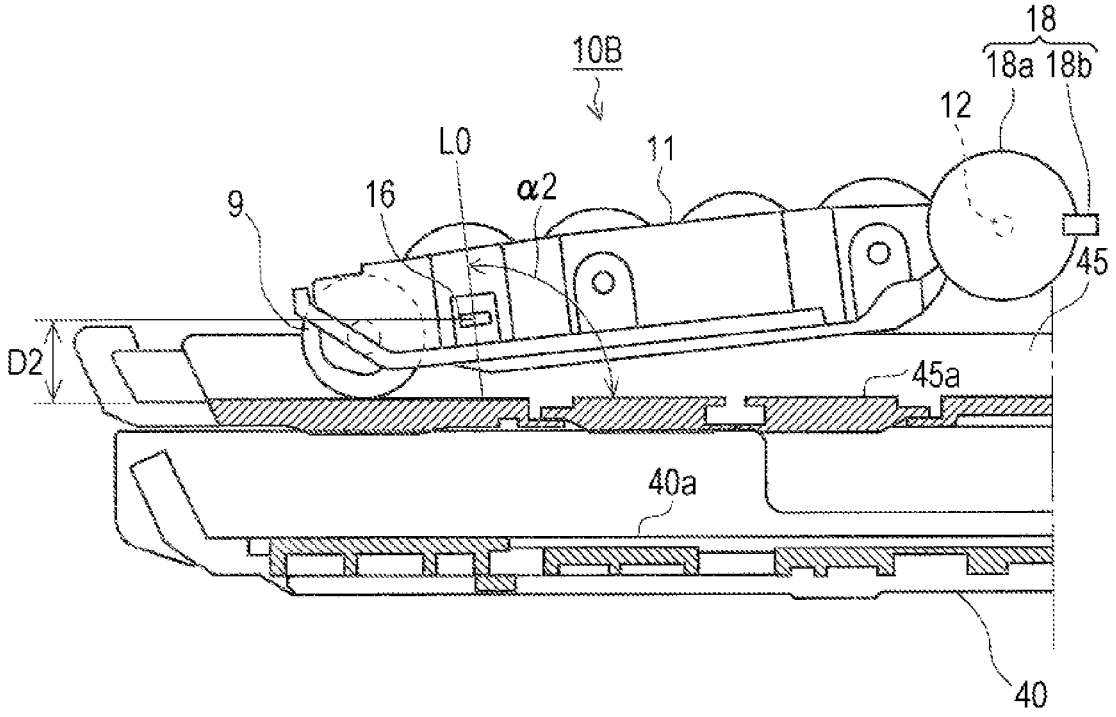
FIG. 7A is a side view of a feeding device which illustrates a state of feeding a sheet from an upper tray.
Figure 7B:
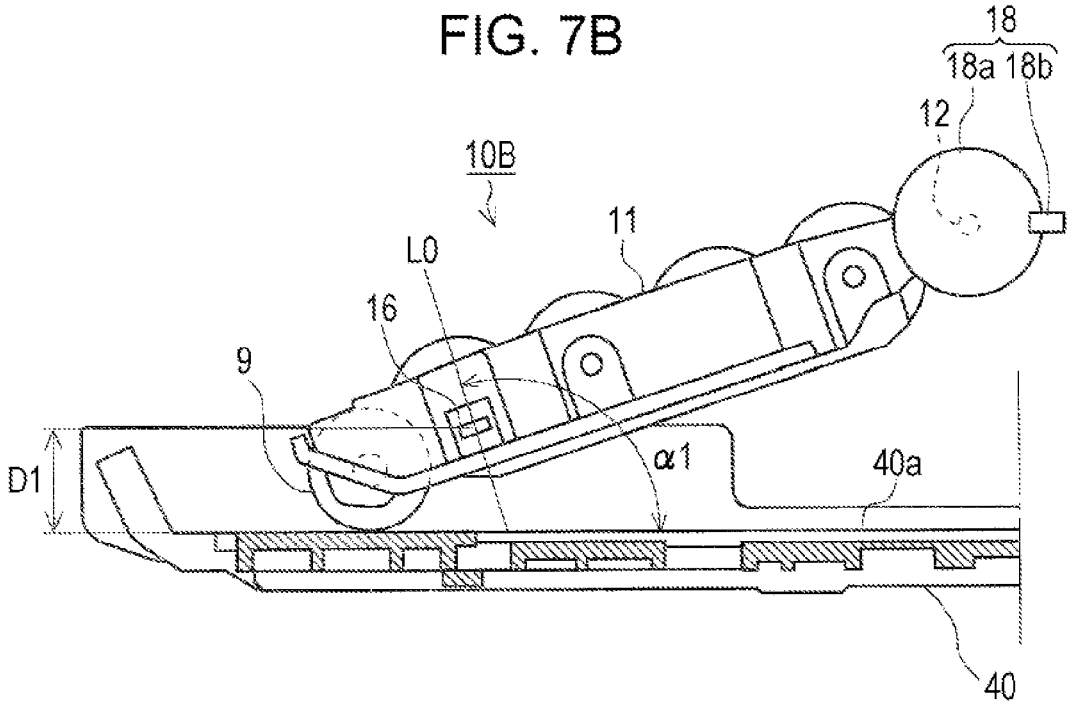
FIG. 7B is a side view of the feeding device which illustrates a state of feeding the sheet from a lower tray, respectively (second embodiment).
Figure 8A:
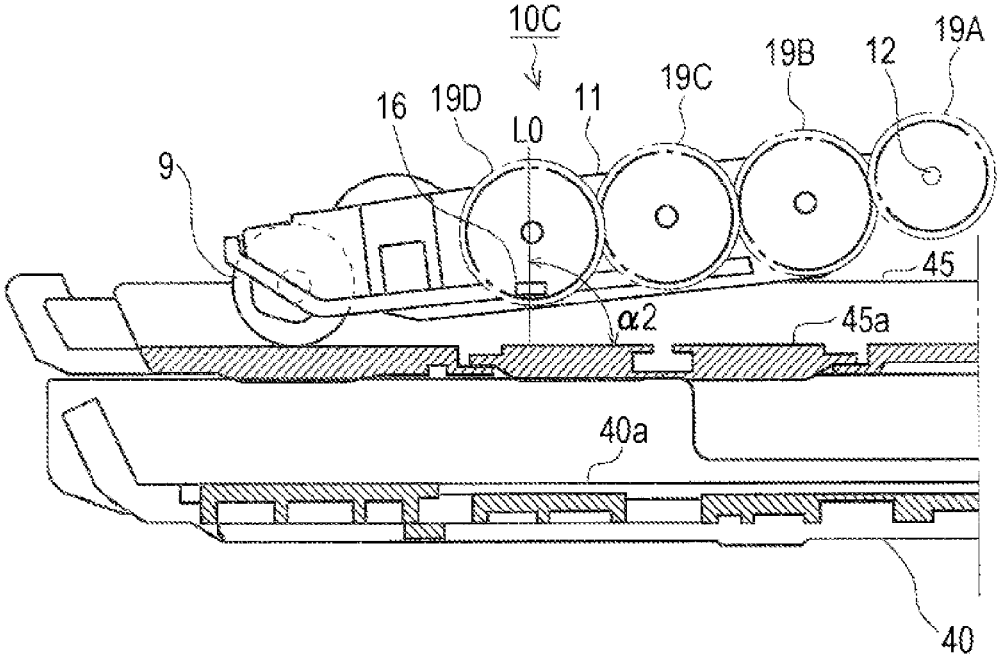
FIG. 8A is a side view of a feeding device which illustrates a state of feeding a sheet from an upper tray.
Figure 8B:
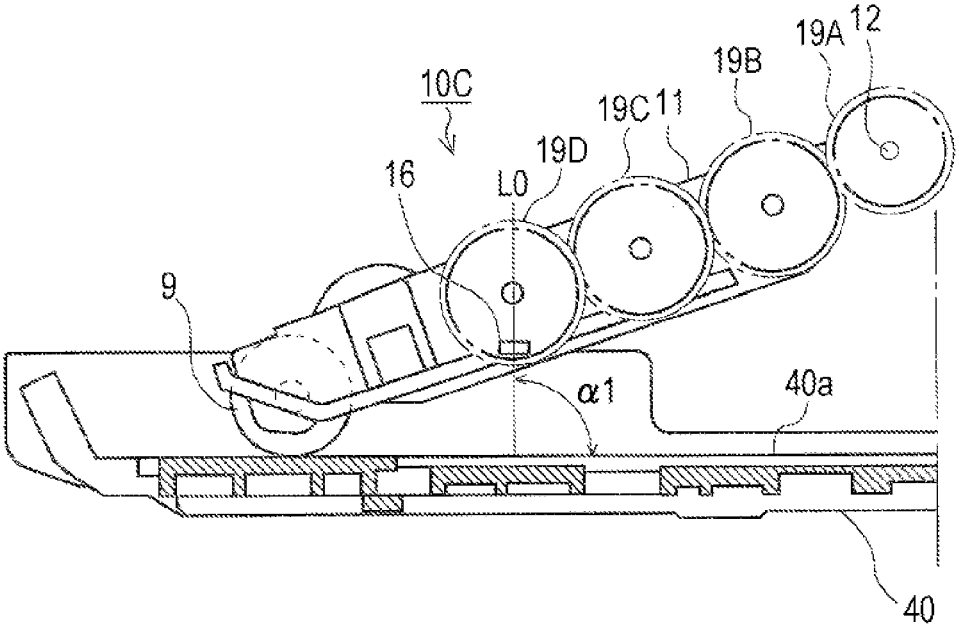
FIG. 8B is a side view of the feeding device which illustrates a state of feeding the sheet from a lower tray, respectively (third embodiment).
Figure 9A:
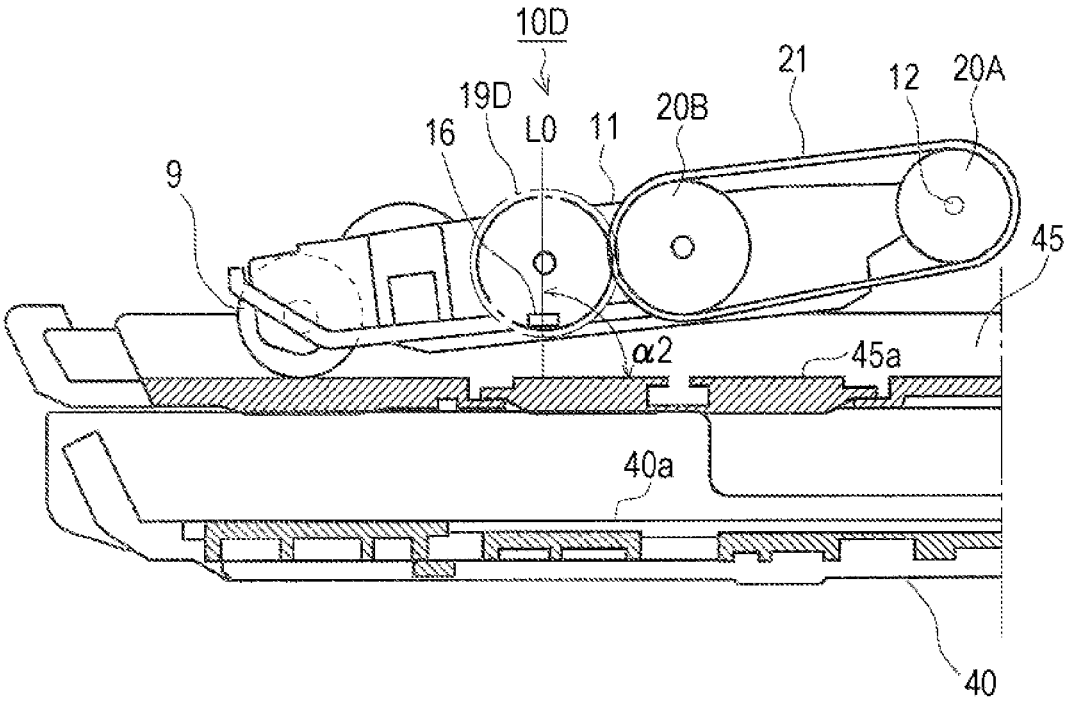
FIG. 9A is a side view of a feeding device which illustrates a state of feeding a sheet from an upper tray.
Figure 9B:
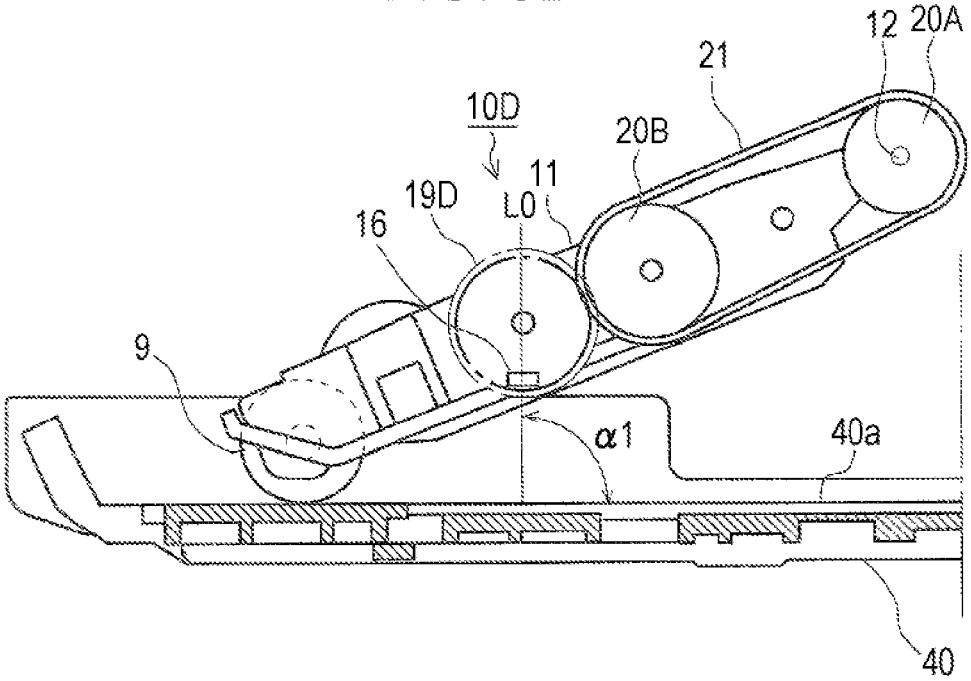
FIG. 9B is a side view of the feeding device which illustrates a state of feeding the sheet from a lower tray, respectively (fourth embodiment).
Figure 10A:
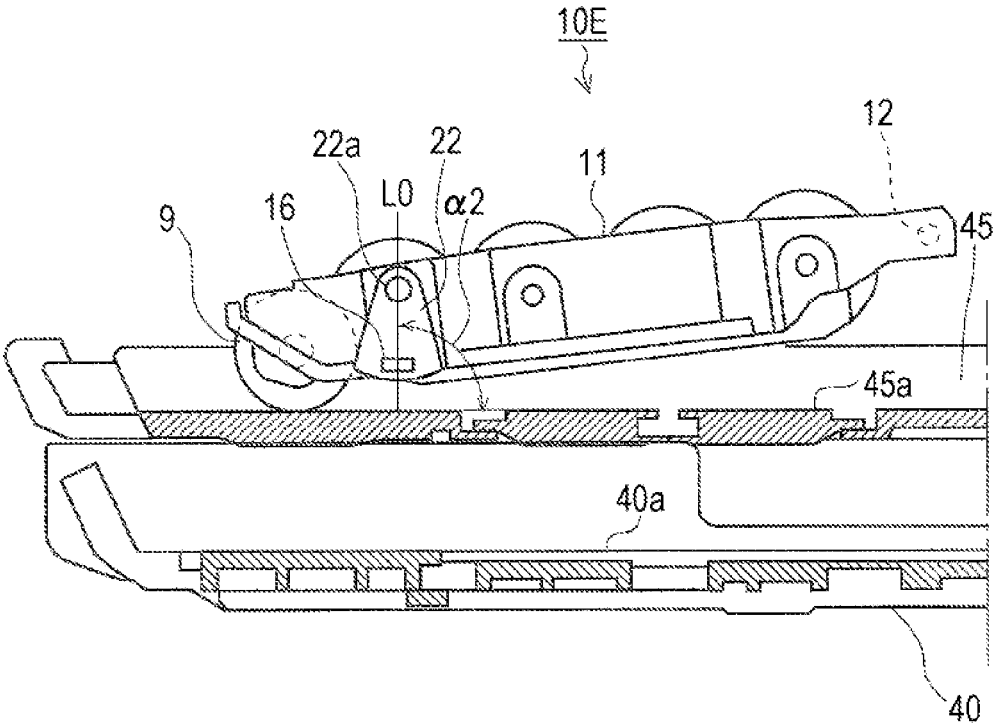
FIG. 10A is a side view of a feeding device which illustrates a state of feeding a sheet from an upper tray.
Figure 10B:
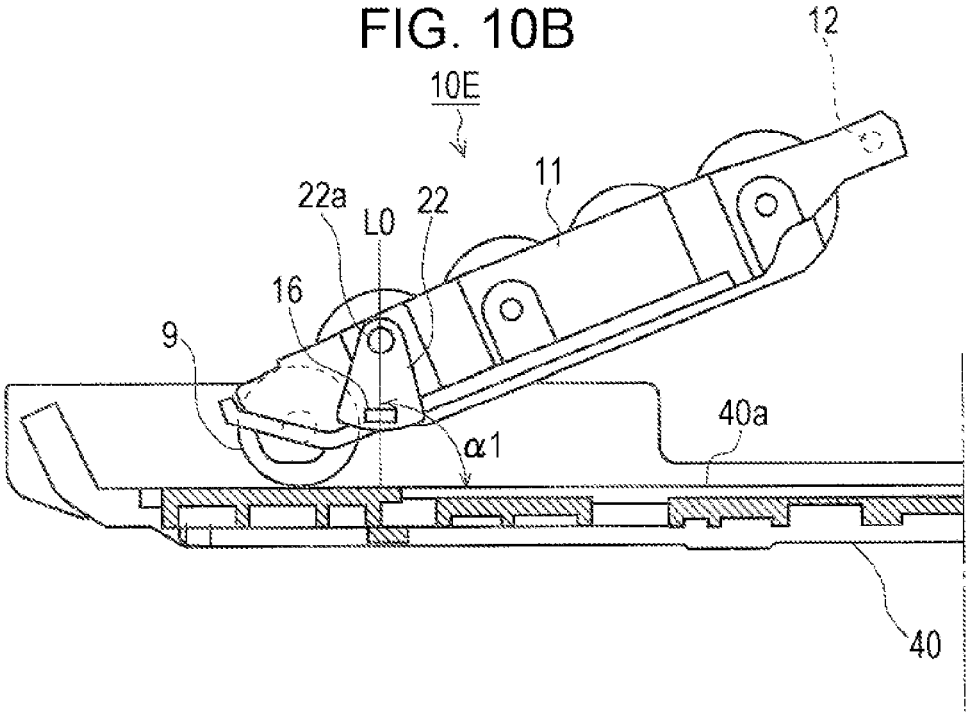
FIG. 10B is a side view of the feeding device which illustrates a state of feeding the sheet from a lower tray, respectively (fifth embodiment).

Therefore, in the first embodiment (roller support member assy 10A) illustrated in FIGS. 6A and 6B, an attachment angle of the optical sensor 16 is set so that the detection angle α1 when the optical sensor 16 opposes the sheet P accommodated in the lower tray 40 (refer to FIG. 6B) is closer to the right angle than the detection angle α2 when the optical sensor 16 opposes the sheet P accommodated in the upper tray 45 (refer to FIG. 6A).

That is, the disadvantageous point is corrected to the advantageous point by causing the disadvantageous point from a viewpoint of the detection distance (case of the lower tray 40: D1>D2) to be the advantageous point in viewpoint of the detection angle (α1 is closer to the right angle than α2), and by causing the advantageous point from a viewpoint of the detection distance (case of the upper tray 45: D2<D1) to be the disadvantageous point in viewpoint of the detection angle (α2 is farther from the right angle than α1). In this manner, regardless of the angle of the roller support member 11, it is possible to perform proper detection (detect the presence or absence of the sheet) in both of the upper tray 45 and the lower tray 40.

3. Second Embodiment of Roller Support Member Assy

Next, a second embodiment of the roller support member assy will be described. In the second embodiment (roller support member assy 10B) illustrated in FIGS. 7A and 7B, the optical sensor 16 is disposed in the roller support member 11 so as to have the same angle as that of the case illustrated in FIGS. 5A and 5B. That is, the detection angle α2 when the optical sensor 16 opposes the upper tray 45 is closer to the right angle than the angle α1 when the optical sensor 16 opposes the lower tray 40. Accordingly, in both of the detection angle and the detection distance, the upper tray 45 is more advantageous than the lower tray 40.

However, the embodiment is different from the configuration illustrated in FIGS. 5A and 5B in that there is provided a posture detection sensor 18 which detects a posture of the roller support member 11, and in that the control unit 52 of the printer 1 controls the light emitting unit 16*a* of the optical sensor 16 to be capable of adjusting light emitting intensity.

The posture detection sensor 18 is configured to include a rotary scale 18*a* which is disposed coaxially with the pivot shaft 12 and a detection unit 18*b* which reads out the rotary scale 18*a*. A control unit (not illustrated) of the printer 1 can understand the posture of the roller support member 11 based on signal information transmitted from the posture detection sensor 18.

The roller support member 11 is configured so that an upward swing movement thereof is restricted at a predetermined position (the posture of the roller support member 11 at this time is referred to as a reference posture). The control unit 52 of the printer 1 can detect the reference posture based on a driving direction of the pivot shaft 12 and the signal information transmitted from the posture detection sensor 18 (information indicating that the swing movement of the roller support member 11 is stopped). Then, based on a swing amount obtained from the reference posture, the control unit 52 can understand the current posture of the roller support member 11.

Then, the control unit 52 of the printer 1 which adjusts the light emitting intensity of the optical sensor 16 adjusts the light emitting intensity according to the posture of the roller support member 11. Specifically, the control unit 52 adjusts the light emitting intensity when the optical sensor 16 opposes the lower tray 40 to be stronger than the light emitting intensity when the optical sensor 16 opposes the upper tray 45. In this manner, the detection angle α1 is farther from the right angle in the case of the lower tray 40. Even when the detection distance D2 becomes longer, it is possible to ensure the light receiving intensity in the light receiving unit 16*b*, and thus it is possible to properly detect the presence or absence of the sheet P.

In addition, since the light emitting intensity becomes weaker in the case of the upper tray 45, it is possible to suppress time-dependent deterioration of the light emitting unit 16*a*. Furthermore, depending on the presence or absence of the lower tray 40 and the presence or absence of the upper tray 45, the posture of the roller support member 11 varies. Accordingly, it is also possible to detect the presence or absence of each tray itself by using the variation. That is, it is also possible to further provide means for detecting whether each tray is attached or detached.

The light emitting intensity can be adjusted in two stages in the case of the lower tray 40 and in the case of the upper tray 45. Alternatively, the light emitting intensity can be further adjusted in multi-stages according to the posture of the roller support member 11. Alternatively, the light emitting intensity can also be adjusted without any stage according to the posture of the roller support member 11.

4. Third Embodiment of Roller Support Member Assy

Next, a third embodiment of the roller support member assy will be described. In the third embodiment (roller support member assy 10C) illustrated in FIGS. 8A and 8B, the optical sensor 16 is attached to a gear 19D serving as a rotating body. Then, the detection angle is defined by the rotation of the gear 19D according to the posture of the roller support member 11.

More specifically, the gear 19D engages with a gear 19A via gears 19C and 19B. The gear 19A is different from the other gears 19B to 19D, and is disposed to be fixed to the roller support member 11. That is, the gear 19A swings together with the roller support member 11. Then, a speed reduction ratio of the gears 19A to 19D is set so that the optical axis L0 of the optical sensor 16 is always perpendicular to each tray, that is, so that the detection angles α1 and α2 are 90° regardless of the posture of the roller support member 11. In this manner, it is possible to always properly detect the presence or absence of the sheet P in each tray.

The optical sensor 16 may be disposed in the gear 19B instead of the gear 19D. In addition, the gear 19D serving as the rotating body may be disposed so as to be independently rotatable by using a drive source. The gear 19D may be configured to be rotated according to the posture of the roller support member 11 by controlling the drive source.

5. Fourth Embodiment of Roller Support Member Assy

Next, a fourth embodiment of the roller support member assy will be described. In the fourth embodiment (roller support member assy 10D) illustrated in FIGS. 9A and 9B, pulleys 20A and 20B and a belt 21 are used instead of the gears 19A to 19C in the above-described third embodiment.

The pulley 20A is disposed to be fixed to the roller support member 11. That is, the pulley 20A swings together with roller support member 11. The pulley 20B is disposed to be rotatable with respect to the roller support member 11. Then, the belt 21 is wound around the pulleys 20A and 20B. The pulley 20B has a two-stage structure. That is, the pulley 20B has a gear portion which engages with the gear 19D in addition to a winding portion of the belt 21.

Similar to the above-described third embodiment, the speed reduction ratio of the gear and the pulleys is set so that the detection angles α1 and α2 are 90° regardless of the posture of the roller support member 11. In this manner, it is possible to always properly detect the presence or absence of the sheet P in each tray.

6. Fifth Embodiment of Roller Support Member Assy

Next, a fifth embodiment of the roller support member assy will be described. In the fifth embodiment (roller support member assy 10E) illustrated in FIGS. 10A and 10B, the optical sensor 16 is attached to a pendulum 22.

The pendulum 22 is disposed to be freely swingable about a swing shaft 22*a*. A self-weight thereof allows the pendulum 22 to maintain a predetermined posture regardless of the posture of the roller support member 11. In this manner, the detection angles α1 and α2 are 90° regardless of the posture of the roller support member 11. Therefore, it is possible to always properly detect the presence or absence of the sheet P in each tray.

The respective embodiments described above employs the optical sensor of a non-contact type as a detection unit that detects the presence or absence of the sheet. However, an optical sensor of a contact type which comes into contact with the sheet may be employed.

Wiring of FFC (First Example)

Figure 11:
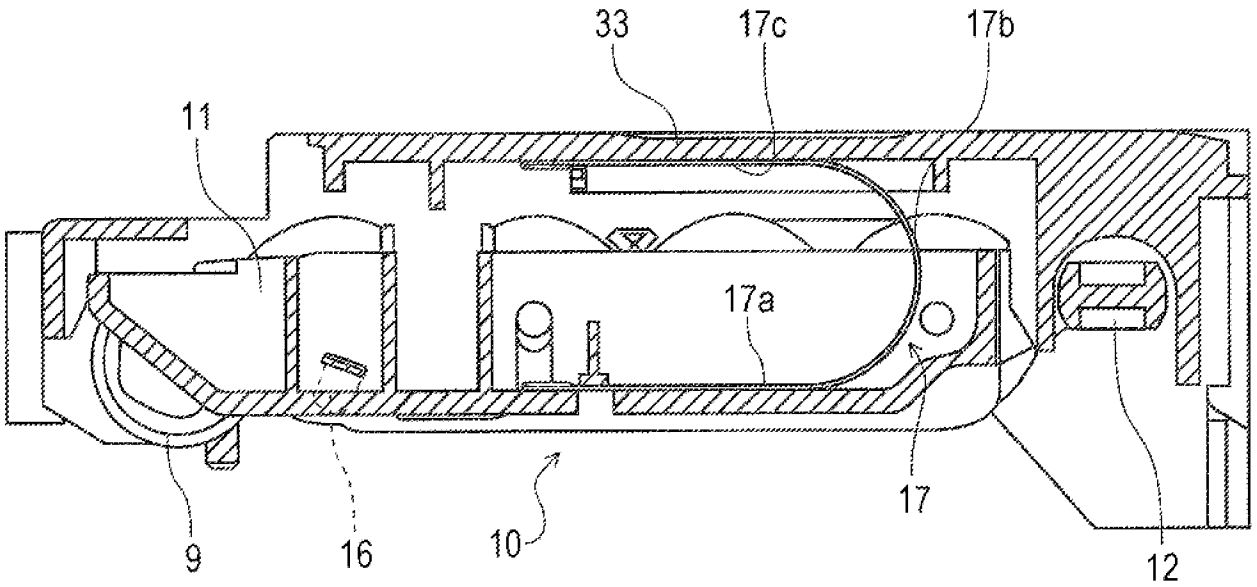
FIG. 11 is a side cross-sectional view of a roller support member assembly and vicinity of an attachment portion thereof (first example).
Figure 12:
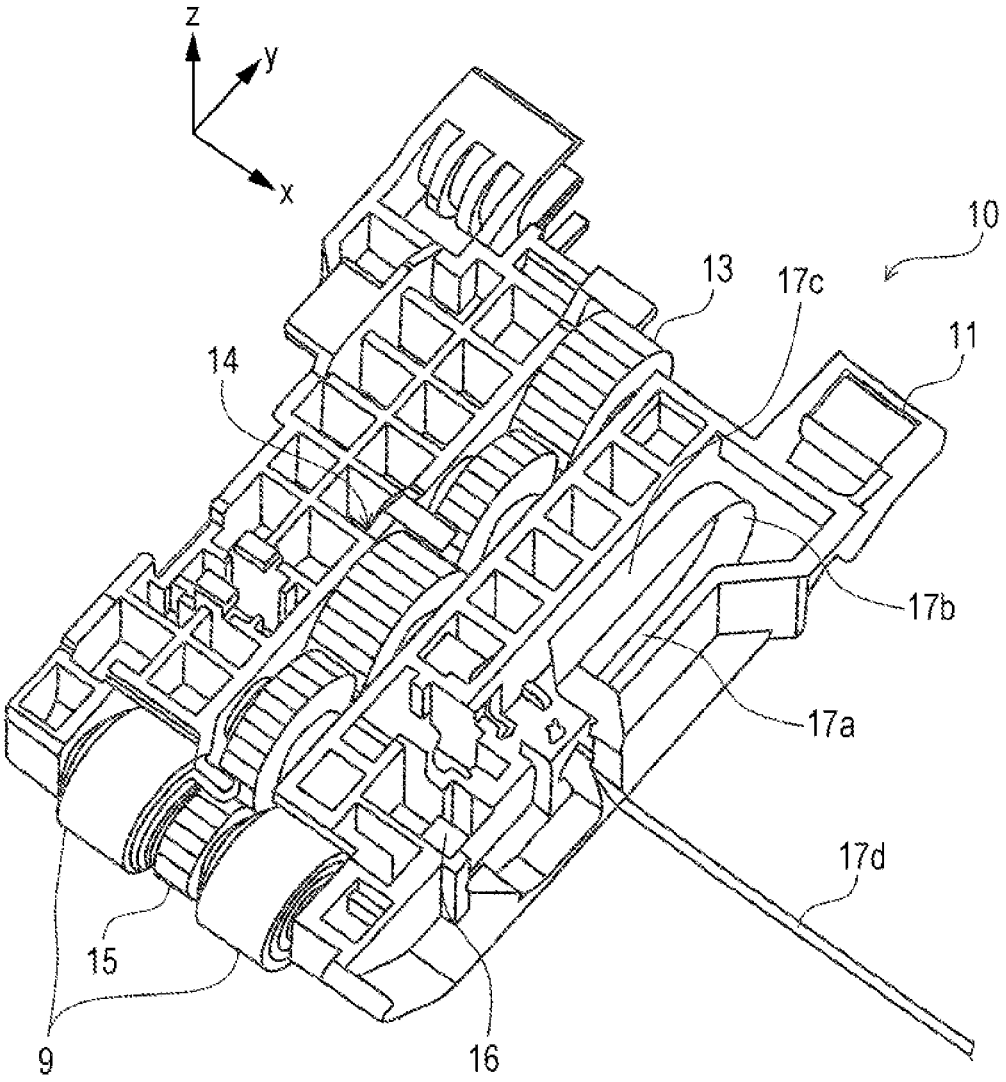
FIG. 12 is a perspective view of the roller support member assembly (first example).
Figure 13:
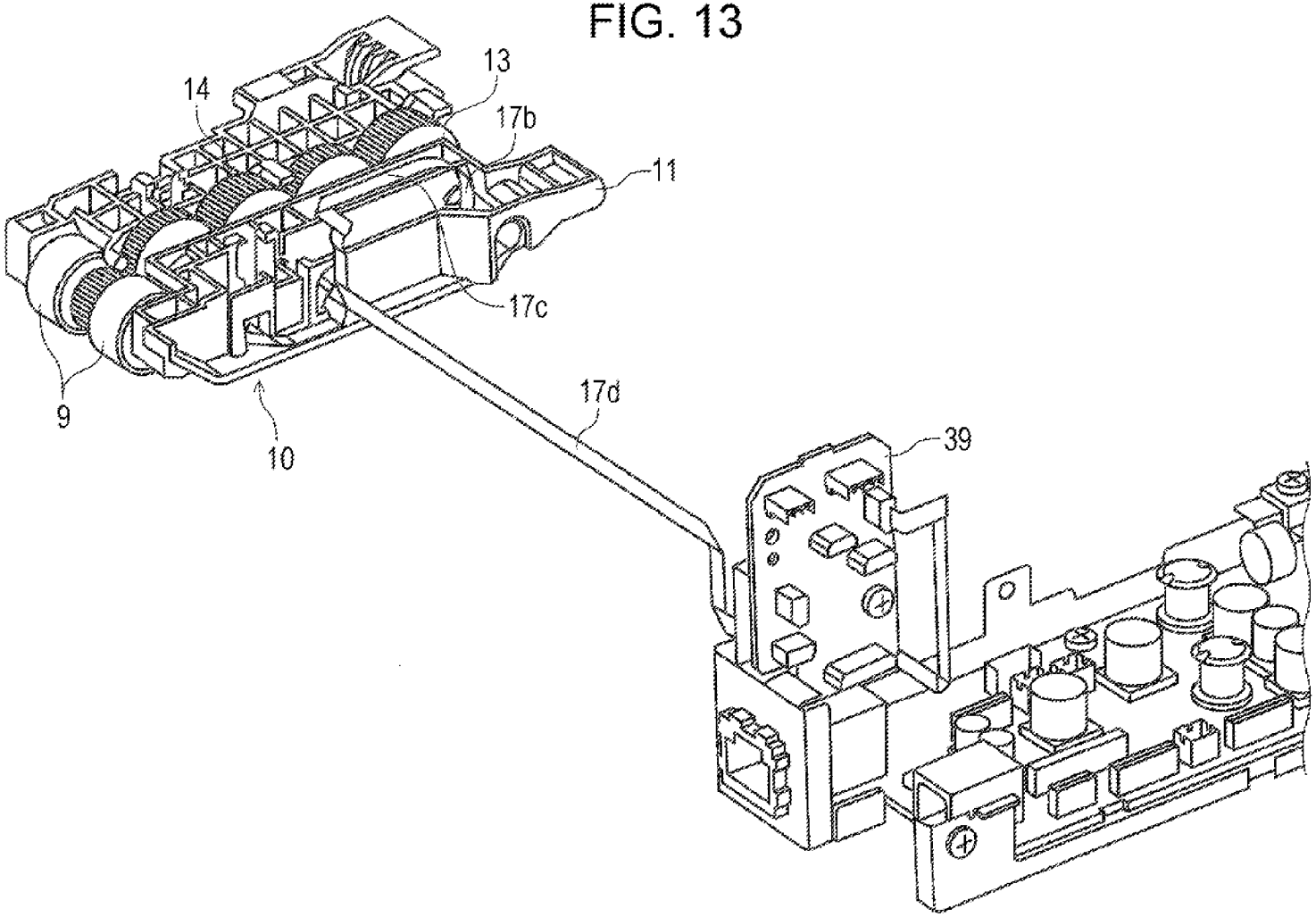
FIG. 13 is a perspective view of the roller support member assembly, a circuit board and an FFC (first example).
Figure 15:
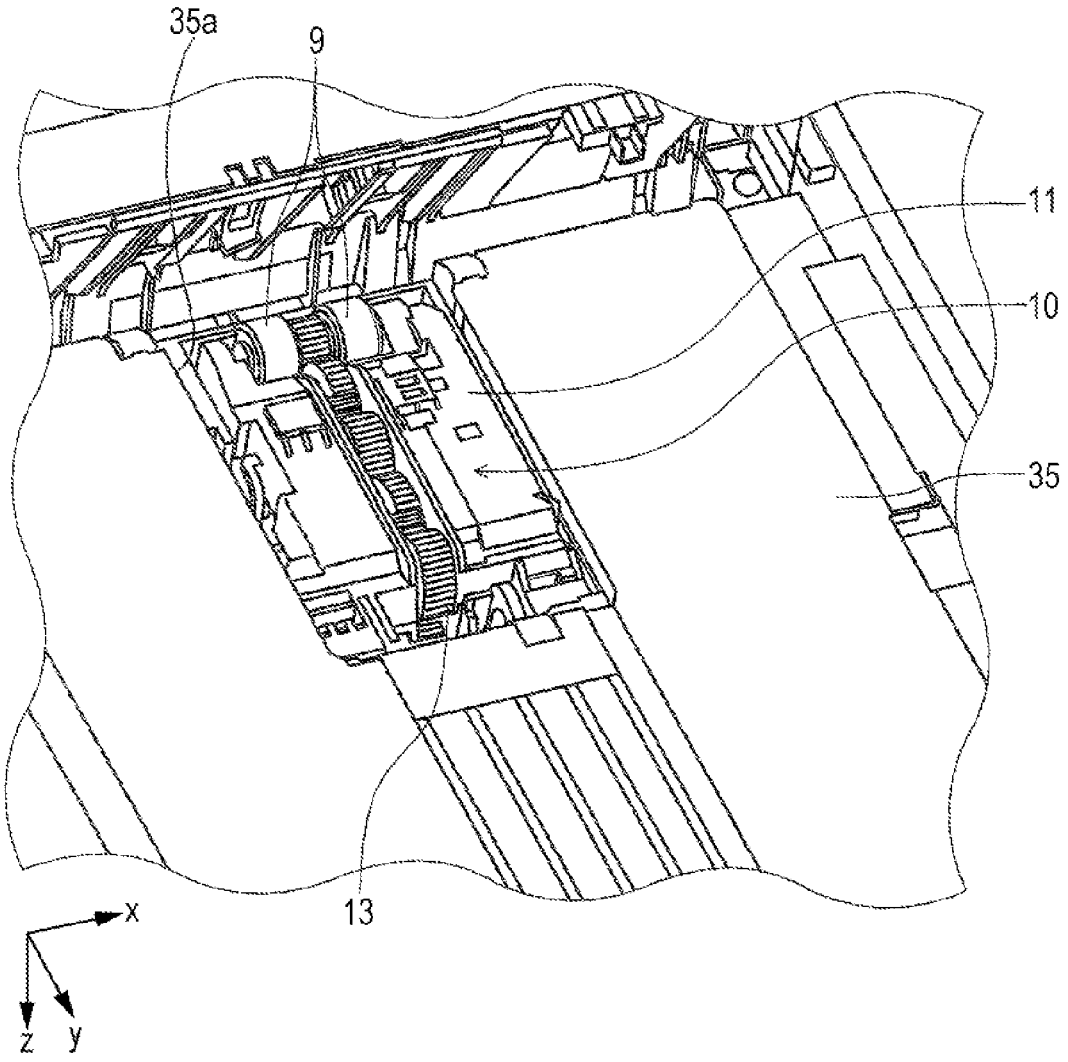
FIG. 15 is a partial enlarged view of FIG. 14.
Figure 16:
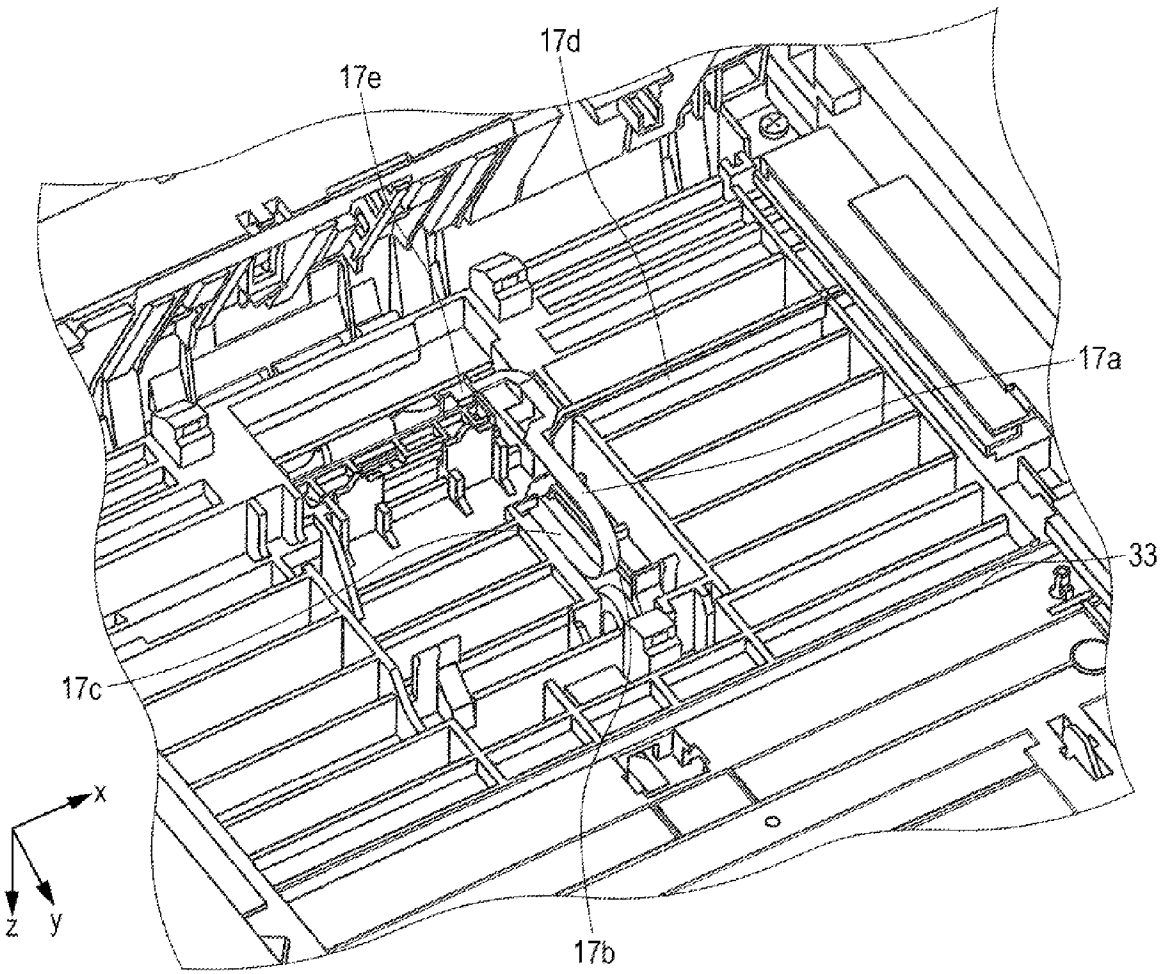
FIG. 16 illustrates a state where a partition plate and the roller support member assembly are detached from the apparatus in FIG. 15.

Subsequently, a first example in wiring a flexible flat cable (FFC) which electrically connects the roller support member assy 10 and a circuit board 39 will be described with reference to FIGS. 11 to 16. FIG. 11 is a side cross-sectional view of the roller support member assy 10 and vicinity of an attachment portion thereof. FIG. 12 is a perspective view of the roller support member assy 10. FIG. 13 is a perspective view of the roller support member assy 10, the circuit board 39 and the FFC 17. FIG. 14 is a perspective view of a bottom surface of the apparatus in a state where the upper tray 45 and the lower tray 40 are detached from the apparatus. FIG. 15 is a partial enlarged view of FIG. 14. FIG. 16 illustrates a state where a partition plate 35 and the roller support member assy 10 are detached from the apparatus in FIG. 15.

In FIGS. 11 to 16, a reference numeral 17 represents the flexible flat cable (hereinafter, referred to as the "FFC") which connects the optical sensor 16 and the circuit board 39. The circuit board 39 is hardware configuring a control unit of the printer 1, and is disposed on one side of the apparatus body 2, between a frame for supporting the carriage and an exterior of the apparatus body 2 (details are not illustrated).

In the roller support member 11, the optical sensor 16 is disposed closer to the circuit board 39 than a gear train 14. Accordingly, it is possible to wire the FFC 17 without bypassing the gear train 14. That is, it is possible to further shorten the length of the FFC 17.

Here, the optical sensor 16 is disposed in the roller support member 11 which is swingable. Therefore, it is necessary to wire the FFC 17 so that excessive tension or compression which is caused by the swing operation of the roller support member 11 is not applied to the FFC 17. In addition, when a user attaches or detaches the lower tray 40 and the upper tray 45, or when the user removes the sheet due to paper jam occurring, it is necessary to wire the FFC 17 so that the user's finger is not caught on the FFC 17.

From this viewpoint, the FFC 17 according to the embodiment is wired as follows. The wiring of the FFC 17 will be described from the optical sensor 16 side to the circuit board 39. The FFC 17 is extended from a straight portion 17*a* inside the roller support member 11 to an upper side of the roller support member 11 via a U-shaped reversing portion 17*b*. The FFC 17 is wired so that a straight portion 17*c* extends along an opposite side surface (lower side surface) to a sheet guide surface of the guide member 33.

In this manner, the FFC 17 forms the U-shaped reversing portion 17*b* in the region of the roller support member 11. Accordingly, even when the roller support member 11 swings, the excessive tension or compression is not applied to the FFC 17, thereby enabling a stable swing operation.

Next, the FFC 17 is wired below the guide member 33 as illustrated in FIG. 16. A wiring region of the FFC 17 below the guide member 33 is shielded from an accommodation region of the upper tray 45 and the lower tray 40 by a partition plate 35 as illustrated in FIGS. 14 and 15. Moreover, the FFC 17 is arranged so as to be extended from the roller support member 11 to the upper side (lower side in FIGS. 14 and 15). Accordingly, even when a user attaches or detaches the upper tray 45 and the lower tray 40, the user's finger does not come into contact with the FFC 17, and is not caught on the FFC 17.

The partition plate 35 is a plate member which vertically partitions an internal space of the apparatus. More specifically, the partition plate 35 partitions the internal space into an accommodation space for the upper tray 45 and the lower tray 40 and an upper space thereof (accommodation space for the discharge sheet receiving tray 8) (also refer to FIG. 2). A cutout portion 35*a* is formed on the partition plate 35, and the roller support member assy 10 is arranged inside the cutout portion 35*a*.

Then, after a straight portion 17*d* extending to the circuit board 39 passes through the lower side (upper side in FIG. 16) of the guide member 33, the FFC 17 is not exposed to the sheet transport route and is connected to the circuit board 39 so as not to interfere with the frame. Accordingly, even when a user puts one's finger into the sheet guide surface inside the sheet transport route in order to remove the sheet jammed due to the paper jam occurring, the FFC 17 is wired so as to extend along the opposite side surface (lower side surface) to the sheet guide surface. Accordingly, the user's finger does not come into contact with the FFC 17, and is not caught on the FFC 17.

Wiring of FFC (Second Example)

Figure 17:
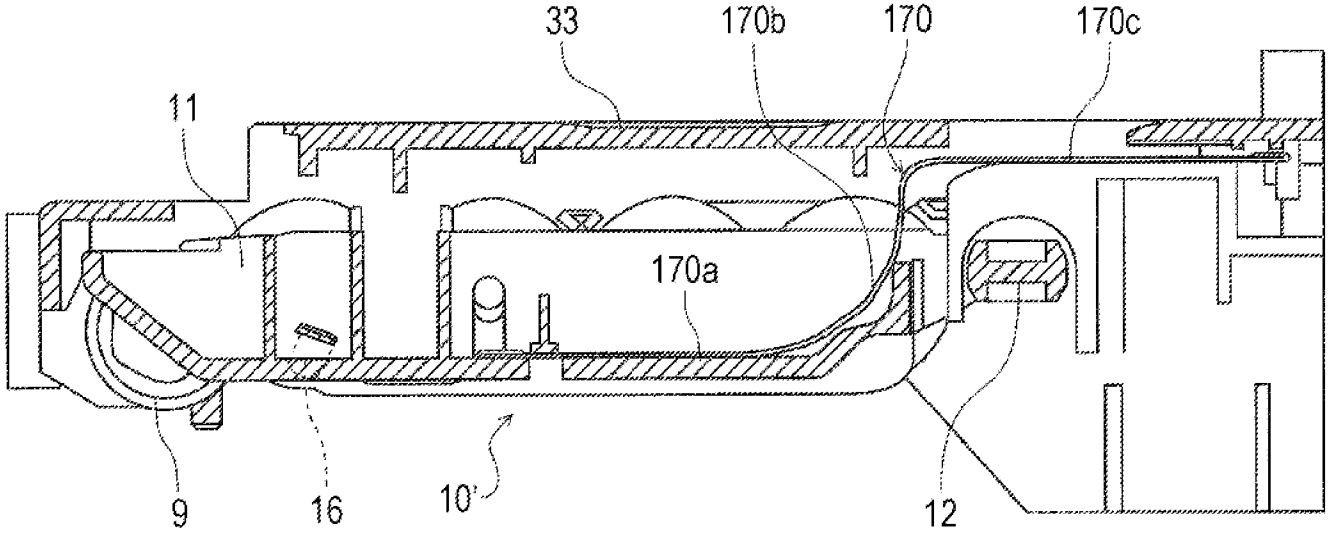
FIG. 17 is a side cross-sectional view of a roller support member assembly and vicinity of an attachment portion thereof (second example).

Subsequently, a second example in wiring a FFC will be described with reference to FIGS. 17 to 19. FIG. 17 is a side cross-sectional view of a roller support member assy 10' and vicinity of an attachment portion thereof. FIG. 18 is a perspective view from above, in which some configurations of the printer body are appropriately detached from the printer body. FIG. 19 is a partial enlarged view of FIG. 18. A reference numeral 170 will be given to the FFC in the embodiment.

In the embodiment, unlike the above-described example, as illustrated in FIG. 17, the FFC 170 is extended from the straight portion 170*a* inside the roller support member 11 to the upper side of the roller support member 11 via a bent portion 170*b* which is bent without U-shaped reversing. The FFC 170 is wired so that a straight portion 170*c* reaches the lower side of the guide member 33.

In this manner, the FFC 170 forms the bent portion 170*b* in the region of the roller support member 11. Accordingly, even when the roller support member 11 swings, the excessive tension or compression is not applied to the FFC 170, thereby enabling a stable swing operation. Even in the embodiment, the wiring region of the FFC 170 in the opposite side to the sheet guide surface of the guide member 33 is shielded from the accommodation region of the upper tray 45 and the lower tray 40 by a partition plate 35 as illustrated in FIGS. 14 and 15. Moreover, the FFC 170 is arranged so as to be extended from the roller support member 11 to the upper side. Accordingly, even when a user attaches or detaches the upper tray 45 and the lower tray 40, the user's finger does not come into contact with the FFC 170, and is not caught on the FFC 170.

Next, the FFC 170 is extended from the lower side to the upper side of the guide member 33 (refer to FIGS. 18 and 19), forms the straight portion 170*c* by changing a direction to a side of the apparatus, and reaches the circuit board 39. Here, as illustrated in FIG. 1, a sheet switch-back transport region for two-sided printing is formed in the upper side region of the guide member 33. However, a straight portion 170*d* of the FFC 170 passes through the opposite side surface to the sheet guide surface of a guide member 34 which forms the sheet transport route together with the guide member 33. Then, the straight portion 170*d* of the FFC 170 is connected to the circuit board 39 without being exposed to the sheet transport route.

Accordingly, even when a user put one's finger into the sheet transport route in order to remove the sheet jammed due to the paper jam occurring, the user's finger does not come into contact with the FFC 170, and is not caught on the FFC 170. The straight portion 170*c* of the FFC 170 is partially exposed to the sheet transport route (refer to FIG. 19), but the exposed portion is in a state buried by multiple ribs 33*a* formed so as to extend in the sheet transport direction in the upper side of the guide member 33 as illustrated in FIG. 19. Moreover, since the straight portion 170*c* extends along the sheet transport direction, even when a user put one's finger into the sheet transport route, the user's finger is not caught on the straight portion 170*c*.

In the above-described embodiments, the optical sensor 16 is disposed in the roller support member 11. However, without being limited thereto, the optical sensor 16 may be disposed in an interlocking member which is operated by being interlocked with the roller support member 11. For example, the optical sensor 16 may be disposed in the other swing member which swings in synchronization with the roller support member 11 (feeding roller 9). An example thereof includes a dummy member that has substantially the same shape as that of the roller support member 11 when the sheet transport route is viewed in a side view, that is disposed at a position different from the arrangement position of the roller support member 11 in the sheet width direction, and that causes a sheet posture (bent posture) during the sheet feeding to be uniform in the sheet width direction.

In addition, in the embodiment, the optical sensor 16 may be disposed in the guide member 33 (refer to FIG. 2) or the partition plate 35 (refer to FIG. 2). In this case, as described in the second embodiment, it is preferable to adjust the light emitting intensity of the light emitting unit 16*a* of the optical sensor 16. More specifically, when detecting the presence or absence of the sheet P in the lower tray 40, it is preferable to further strengthen the light emitting intensity as compared to when detecting the presence or absence of the sheet P in the upper tray 45.

In addition, in the above-described embodiments, it is assumed that the optical sensor 16 detects the presence or absence of the sheet P in the tray which performs the recording (which feeds the sheet), out of the multiple medium accommodation units, that is, between the lower tray 40 and the upper tray 45. However, without being limited thereto, the optical sensor 16 may detect the presence or absence of the sheet P in the tray which does not feed the sheet P. That is, the invention is characterized in that one optical sensor 16 detects the presence or absence of the sheet P in the multiple trays, in other words, in that one optical sensor 16 is shared by the multiple trays. Therefore, it is possible to appropriately set which tray is targeted to detect the presence or absence of the sheet P, or when the detection is to be performed. In addition, regardless of the recording operation or the sheet feeding operation, only detecting the presence or absence of the sheet P may be independently performed.

The entire disclosure of Japanese Patent Application No. 2013-067563, filed Mar. 27, 2013 is expressly incorporated by reference herein.

What is claimed is:

1. A recording apparatus comprising:

a recording unit that performs recording on a medium;

a lower medium accommodation unit;

an upper medium accommodation unit positioned above the lower medium accommodation unit, the upper medium accommodation unit being slidingly operable with respect to the lower medium accommodation unit;

a feeding member that is swingable and feeds the medium from the lower and upper medium accommodation units, the feeding member including a swing pivot point disposed on a first end and a feed roller disposed on an opposite end from the swing pivot point; and a medium detection unit that detects the presence or absence of the medium inside the upper and lower medium accommodation units, wherein the medium detection unit is configured to have an optical sensor that includes a light emitting unit and a light receiving unit which oppose the medium accommodated in the upper and lower medium accommodation units, and wherein the light receiving unit is disposed in the feeding member, wherein a straight line is formed between the feed roller and the swing pivot point and an optical axis is formed between the light emitted by the light emitting unit and the medium in the upper and lower medium accommodation units, wherein a constant attachment angle of the optical sensor is set in relation to the straight line and to the optical axis such that an angle $\alpha 1$ formed between the optical axis of light emitted from the light emitting unit and the medium when the light emitting unit opposes the medium accommodated in the lower medium accommodation unit is closer to a right angle than an angle $\alpha 2$ formed between the optical axis and the medium when the light emitting unit opposes the medium accommodated in the upper medium accommodation unit.

2. The recording apparatus according to claim 1, wherein the medium detection unit is connected to a circuit board which is arranged at a position separated from the feeding member by a signal line, and wherein the signal line is wired to a position which is shielded from a transport route through which the medium is transported.

3. The recording apparatus according to claim 2, wherein the signal line is arranged in a region facing the medium accommodation unit and at the position which is shielded from the transport route.

4. The recording apparatus according to claim 1, wherein the feeding member has a feeding roller and a gear group which transmits drive force to the feeding roller, and wherein in the feeding member, the medium detection unit is disposed closer to the circuit board than the gear group.

5. A recording apparatus comprising:

a recording unit that performs recording on a medium;

a medium accommodation unit that accommodates the medium;

a feeding member that is swingable and feeds the medium from the medium accommodation unit; and a medium detection unit that detects the presence or absence of the medium inside the medium accommodation unit, wherein the medium detection unit is configured to have an optical sensor that includes a light emitting unit and a light receiving unit which oppose the medium accommodated in the medium accommodation unit, and wherein the light receiving unit is disposed in the feeding member, wherein the feeding member has a pendulum which maintains a predetermined posture regardless of a posture of the feeding member, and the pendulum has the optical sensor.

6. A recording apparatus comprising:

a recording unit that performs recording on a medium;

a lower medium accommodation unit;

an upper medium accommodation unit positioned above the lower medium accommodation unit, the upper medium accommodation unit being slidingly operable with respect to the lower medium accommodation unit;

a feeding member that is swingable and feeds the medium from the lower and upper medium accommodation units; and a medium detection unit that is disposed in the feeding member and detects the presence or absence of the medium inside the upper and lower medium accommodation units, wherein the medium detection unit is configured to have an optical sensor that includes a light emitting unit and a light receiving unit which oppose the medium accommodated in the lower medium accommodation unit and in the upper medium accommodation unit, and wherein the light receiving unit is disposed in the feeding member, wherein the light emitting unit can adjust light emitting intensity, and wherein a controller adjusts the light emitting intensity of the light emitting unit to be stronger when the feeding member opposes the medium accommodated in the lower medium accommodation unit than when the feeding member opposes the medium accommodated in the upper medium accommodation unit.

* * * * *